US007445533B2

(12) United States Patent
Norton et al.

(10) Patent No.: US 7,445,533 B2
(45) Date of Patent: Nov. 4, 2008

(54) INFLATION DEVICE

(76) Inventors: David Norton, P.O. Box 8, 8908 Paradise Trail, Carp Lake, MI (US) 49718; Robert Overholt, 5050 Country Dr., Okemos, MI (US) 48864; Clarence Underwood, 1522 Stanlake, East Lansing, MI (US) 48823; Gary Walker, 01448 M-66N, East Jordan, MI (US) 49727; William Demmer, 6151 W. Longview, East Lansing, MI (US) 48823; Edward Demmer, 5503 Old Delta River Dr., Lansing, MI (US) 48906

( * ) Notice: Subject to any disclaimer, the term of this patent is extended or adjusted under 35 U.S.C. 154(b) by 39 days.

(21) Appl. No.: 11/800,636

(22) Filed: May 7, 2007

(65) Prior Publication Data

US 2007/0275615 A1 Nov. 29, 2007

Related U.S. Application Data

(60) Provisional application No. 60/798,975, filed on May 9, 2006.

(51) Int. Cl.
*B63C 9/15* (2006.01)

(52) U.S. Cl. ..... 441/90; 137/228; 141/38

(58) Field of Classification Search ..... 441/90, 441/91, 92; 137/224, 226, 227, 228, 231; 141/38, 40

See application file for complete search history.

(56) References Cited

U.S. PATENT DOCUMENTS 4,969,493 A * 11/1990 Lee ..... 141/38
5,148,712 A * 9/1992 Cross et al. ..... 137/228
7,320,347 B2 * 1/2008 Ramsey et al. ..... 141/38

* cited by examiner

*Primary Examiner*—Lars A Olson
(74) *Attorney, Agent, or Firm*—Ian C. McLeod

(57) ABSTRACT

An inflation device and method for inflating or deflating inflatable objects, such as game balls is disclosed. The inflation device measures the pressure of a game ball and inflates or deflates the ball to a pressure selected by the user. Also disclosed is an injection apparatus that can be used to automatically retract an injection needle from the game ball or other inflatable object.

14 Claims, 26 Drawing Sheets

INFLATION DEVICE

CROSS-REFERENCE TO RELATED APPLICATION

This application claims benefit of U.S. Provisional Application No. 60/798,975, filed May 9, 2006, which is incorporated herein by reference in its entirety.

STATEMENT REGARDING FEDERALLY SPONSORED RESEARCH OR DEVELOPMENT

Not Applicable.

REFERENCE TO A "COMPUTER LISTING APPENDIX SUBMITTED ON A COMPACT DISC"

Not Applicable.

BACKGROUND OF THE INVENTION (1) Field of the Invention

The present invention relates to an inflation device for inflating or deflating game balls. In particular, the present invention relates to an inflation device which measures the pressure of a game ball and inflates or deflates the game ball to a pressure selected by the user.

(2) Description of Related Art

In various competitive sports using inflatable game balls, the pressure of the game ball is set to a specific pressure prior to the start of the game. When a game ball is damaged, another game ball having essentially the same pressure is used. It is essential for fair play that all the game balls used in a game are inflated to essentially the same pressure. The inflation device of the present invention allows for quick and accurate inflation of game balls to a preselected pressure. The device consistently inflates the game balls to essentially the preselected pressure. In addition, the inflation device of the present invention, is easy to use and quiet such as to not disrupt the playing of the game. The device is also portable to enable a team to use the device on the court or on the playing field.

SUMMARY OF INVENTION

The present invention provides an injection apparatus for inflating or deflating an inflatable object comprising: a housing having a top wall and an outer wall defining a center bore; an inner wall within the outer wall of the housing and extending across the center bore of the housing; a post slidably mounted in the inner wall; an inflation needle mounted upon an end of the post; a gas transport hose extending through the post and connected to the inflation needle to provide a gas supply to the inflatable object; a piston extending from the post across the center bore of the housing between a top wall and the inner wall so as to define a sealed chamber between the piston and the inner wall of the injection apparatus, the piston being slidably disposed against the outer wall and top wall; and a retraction hose attached to the post to provide gas to the chamber between the piston and the inner wall, wherein when the gas is supplied to the retraction hose, the pressure in the chamber forces the housing down against the inflatable object so as to remove the inflation needle from the inflatable object. In further embodiments of the injection apparatus, the inflatable object comprises a game ball. In still further embodiments, the gas transport hose and the retraction hose are attached to a gas supply means. In some embodiments, the gas supply means is a compressor.

The present invention provides an inflation device for inflating or deflating an inflatable object to a preselected pressure, which comprises: an inflation needle for insertion into an inflatable object; an inflation system comprising a gas supply means and a gas transport hose connected to the gas supply means, the gas transport hose connected to the inflation needle to provide gas to the inflatable object; at least one pressure selector provided on a control panel of the inflation device; a pressure sensor connected to the inflation system; a control circuit that opens valves in the inflation device to inflate or deflate the inflatable object, electrically connected to the pressure sensor and receiving an electrical signal from the pressure selector; and an injection apparatus for inflating or deflating the inflatable object comprising a housing having a top wall and an outer wall defining a center bore; an inner wall within the outer wall of the housing and extending across the center bore of the housing; a post slidably mounted in the inner wall; an inflation needle mounted upon an end of the post; an end of the gas transport hose extending through the post and connected to the inflation needle to provide a gas supply to the inflatable object; a piston extending from the post across the center bore of the housing between a top wall and the inner wall to provide a sealed chamber between the piston and the inner wall of the injection apparatus, the piston being slidably disposed against the outer wall and top wall; and a retraction hose attached to the post to provide gas to the chamber between the piston and the inner wall, wherein when the gas is supplied to the retraction hose, the pressure in the chamber forces the housing down against the inflatable object so as to remove the inflation needle from the inflatable object.

In further embodiments of the inflation device, the control circuit comprises a microprocessor that opens valves to inflate or deflate the inflatable object. In further embodiments, the inflatable object comprises a game ball. In still further embodiments, the gas supply means is a compressor. In some embodiments, at least one pressure selector is provided as buttons or a dial on the control panel. In some embodiments, the inflation device has more than one injection apparatus so as to provide multiple ports for inflating or deflating balls or other inflatable objects.

The present invention provides a method for inflating or deflating an inflatable object to a preselected pressure comprising: providing an inflation device comprising an inflation needle for insertion into an inflatable object; an inflation system comprising a gas supply means and a gas transport hose connected to the gas supply means, the gas transport hose connected to the inflation needle to provide gas to the inflatable object; at least one pressure selector provided on a control panel of the inflation device; a pressure sensor connected to the inflation system; a control circuit that opens valves in the inflation device to inflate or deflate the inflatable object, electrically connected to the pressure sensor and receiving an electrical signal from the pressure selector; and an injection apparatus for inflating or deflating the inflatable object comprising: a housing having a top wall and an outer wall defining a center bore; an inner wall within the outer wall of the housing and extending across the center bore of the housing; a post slidably mounted in the inner wall; an inflation needle mounted upon an end of the post; an end of the gas transport hose extending through the post and connected to the inflation needle to provide a gas supply to the inflatable object; a piston extending from the post across the center bore of the housing between a top wall and the inner wall to provide a sealed chamber between the piston and the inner wall of the injection apparatus, the piston being slidably disposed against the outer wall and top wall; and a retraction hose attached to the post to provide gas to the chamber between the piston and the inner wall, wherein when the gas is supplied to the retraction hose, the pressure in the chamber forces the housing down against the inflatable object so as to remove the inflation needle from the inflatable object; inserting the inflation needle into the inflatable object; selecting a pressure by means of the at least one pressure selector on the inflation device; sensing an initial pressure of the inflatable object with the pressure sensor; adjusting a pressure of the inflatable object to essentially equal to the preselected pressure by supplying gas to or removing gas from the inflatable object; and retracting the inflation needle from the inflatable object when the pressure of the inflatable object is essentially equal to the preselected pressure.

In further embodiments of the method, the control circuit comprises a microprocessor that opens valves to inflate or deflate the inflatable object. In further embodiments, the inflatable object comprises a game ball. In still further embodiments, the gas supply means is a compressor. In some embodiments, the at least one pressure selector is provided as buttons or a dial on the control panel. The substance and advantages of the present invention will become increasingly apparent by reference to the following drawings and the description.

BRIEF DESCRIPTION OF THE DRAWINGS

FIG. 10A illustrates a schematic diagram of a five volt regulator. FIG. 10B illustrates schematic diagram of a six volt regulator. FIG. 10C illustrates a schematic diagram of a −5 V voltage source. FIG. 10D illustrates a schematic diagram of a +12 V voltage source.

BRIEF DESCRIPTION OF THE PREFERRED EMBODIMENTS

All patents, patent applications, government publications, government regulations, and literature references cited in this specification are hereby incorporated herein by reference in their entirety. In case of conflict, the present description, including definitions, will control.

The term "inflatable object" as used herein refers to any inflatable object, including but not limited to inflatable game balls. Some examples of inflatable game balls include, but are not limited to basketballs, soccer balls, and footballs. Other examples include, but are not limited to tires and air mattresses.

Figure 4B:
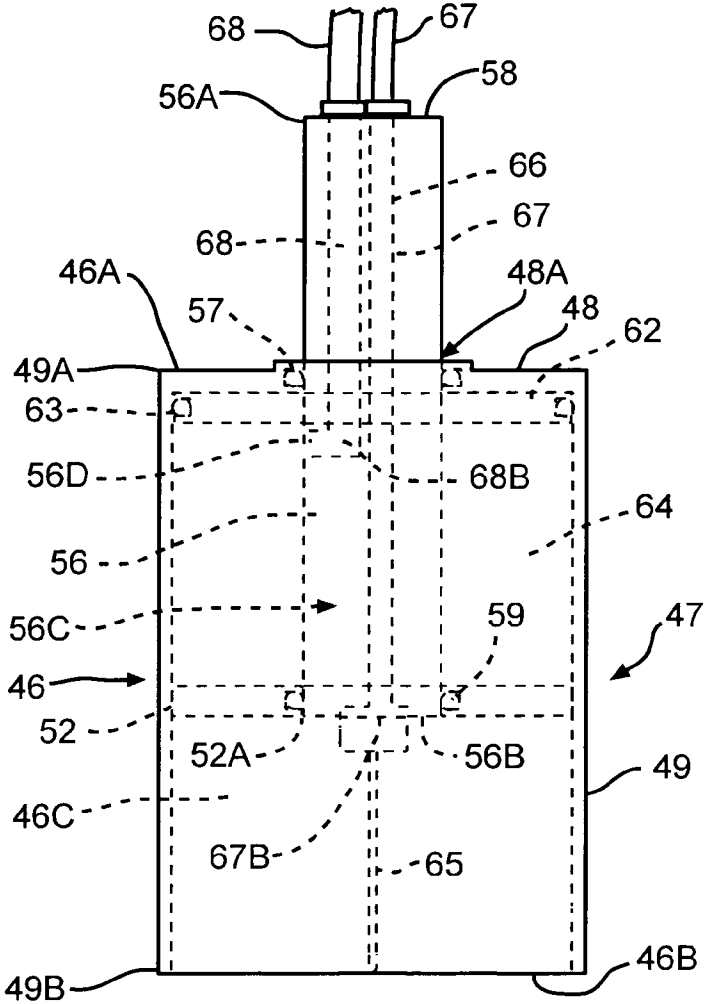
FIG. 4B is a schematic view of the injection apparatus 46 with the inflation needle 65 in the retracted position.
Figure 4A:
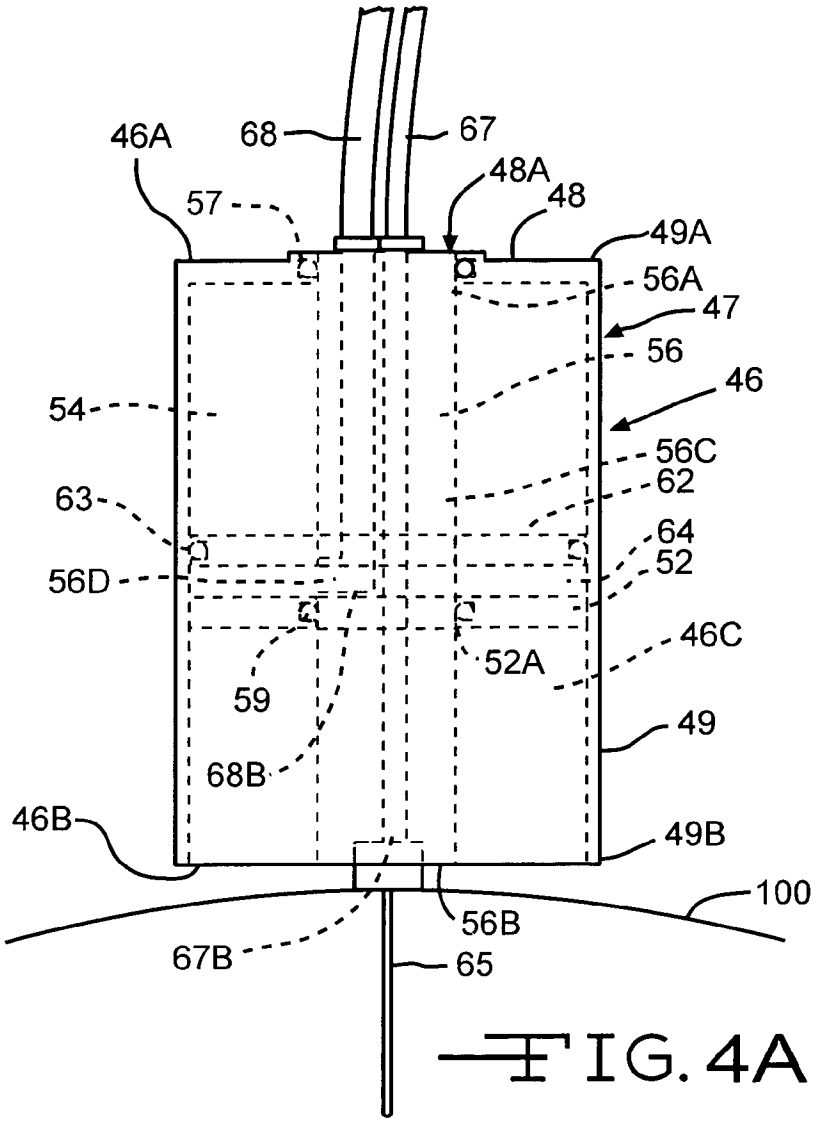
FIG. 4A is a schematic view of the injection apparatus 46 with the inflation needle 65 in the extended position and inserted into the game ball 100.
Figure 5B:
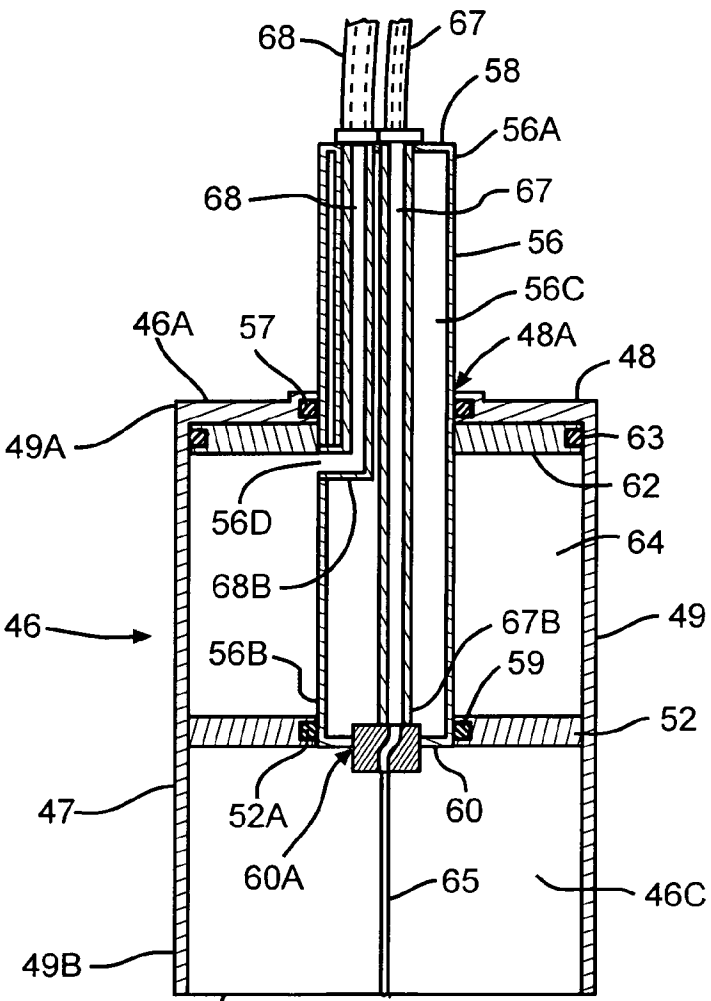
FIG. 5B is a cross-sectional view of the injection apparatus 46 with the inflation needle 65 in the retracted position.
Figure 5A:
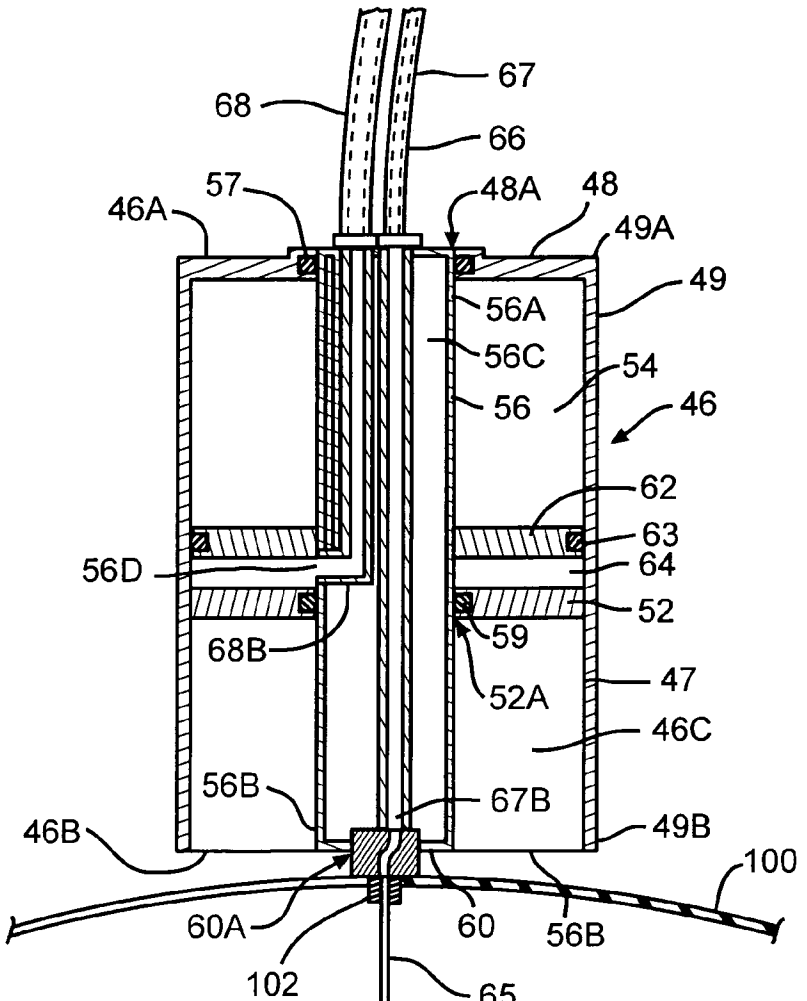
FIG. 5A is a cross-sectional view of the injection apparatus 46 with the inflation needle 65 in the extended position and inserted into the game ball 100.

The present invention provides an injection apparatus for inflating or deflating a an inflatable object. The injection apparatus 46 comprises a housing 47 for enclosing an injection needle 65, as illustrated in FIGS. 4A and B. FIG. 4A is a schematic view of the injection apparatus 46 with the inflation needle 65 in the extended position and inserted into the game ball 100. FIG. 4B is a schematic view of the injection apparatus 46 with the inflation needle 65 in the retracted position. The housing 47 has a top wall 48 and an outer wall 49 defining a center bore 46C in which the injection needle 65 is mounted, as illustrated in FIGS. 5A and B. FIG. 5A is a cross-sectional view of the injection apparatus 46 with the inflation needle 65 in the extended position and inserted into the game ball 100. FIG. 5B is a cross-sectional view of the injection apparatus 46 with the inflation needle 65 in the retracted position. As seen in FIGS. 5A and B, an inner wall 52 is disposed within the outer wall 49 of the housing 47 and extends across the center bore 46C of the housing 47. The inflation needle 65 is mounted upon an end of a post 56, which is slidably mounted in the inner wall 52.

A gas transport hose 67 extends through the post 56 and connects to the inflation needle 65 to provide a gas supply to the inflatable object, such as a game ball 100. A piston 62 extends from the post 56 across the center bore 46C of the housing 47 between a top wall 48 and the inner wall 52 so as to define a sealed chamber 64 between the piston 62 and the inner wall 52 of the injection apparatus 46. The piston 62 is slidably disposed against the outer wall 49, and the post is slidably disposed against the top wall 48. A retraction hose 68 is attached to the post 56 to provide gas to the chamber 64 between the piston 62 and the inner wall 52. Thus, when the gas is supplied to the retraction hose 68, the pressure in the chamber 64 forces the wall 49 of the housing 47 at the second end 46B of the injection apparatus 46 down against the inflatable object, such as the game ball 100, so as to remove the inflation needle 65 from the inflatable object.

Figure 1:
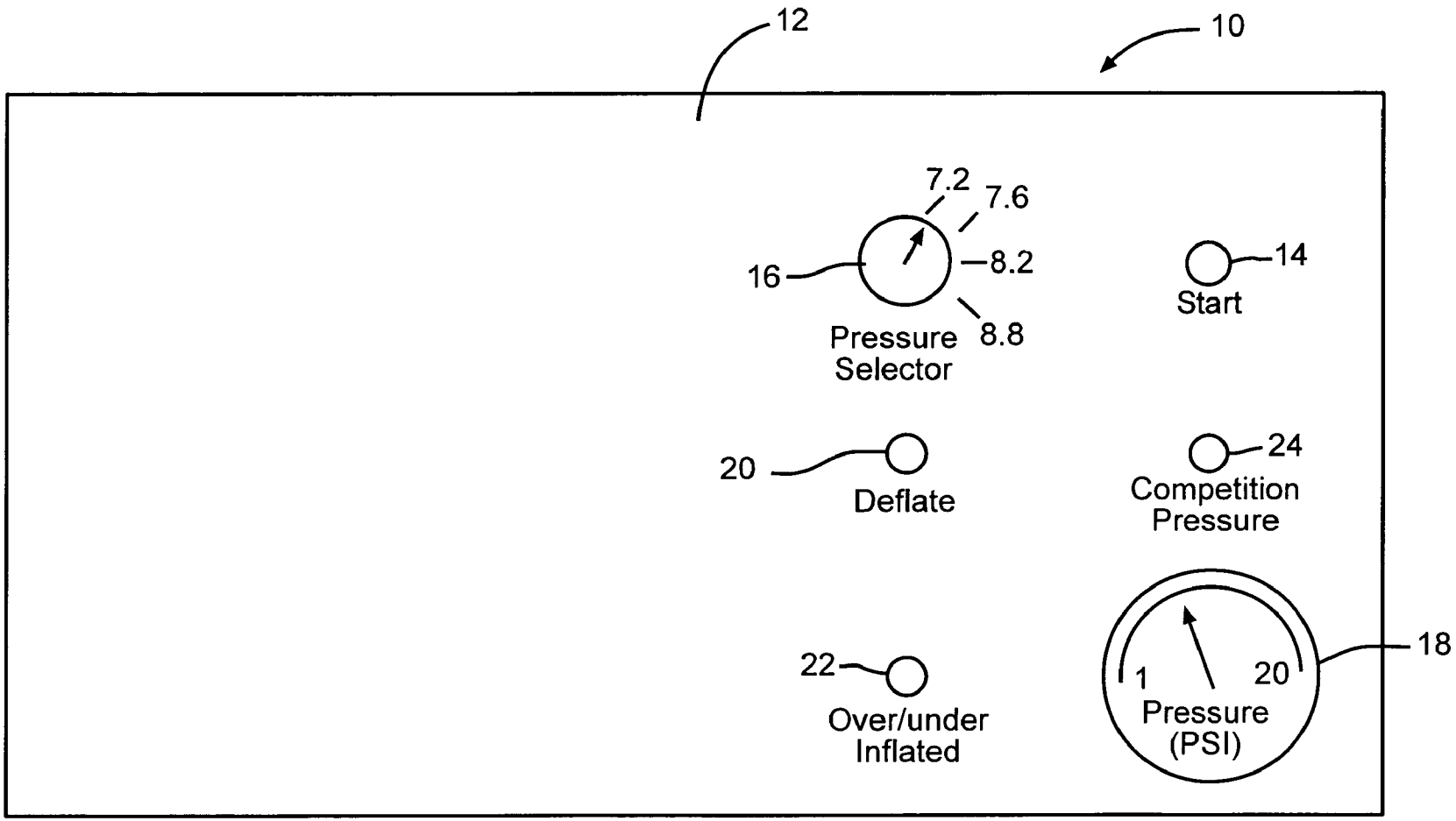
FIG. 1 is a schematic top view of the control panel 12 of a first embodiment of the inflation device 10.
Figure 1A:
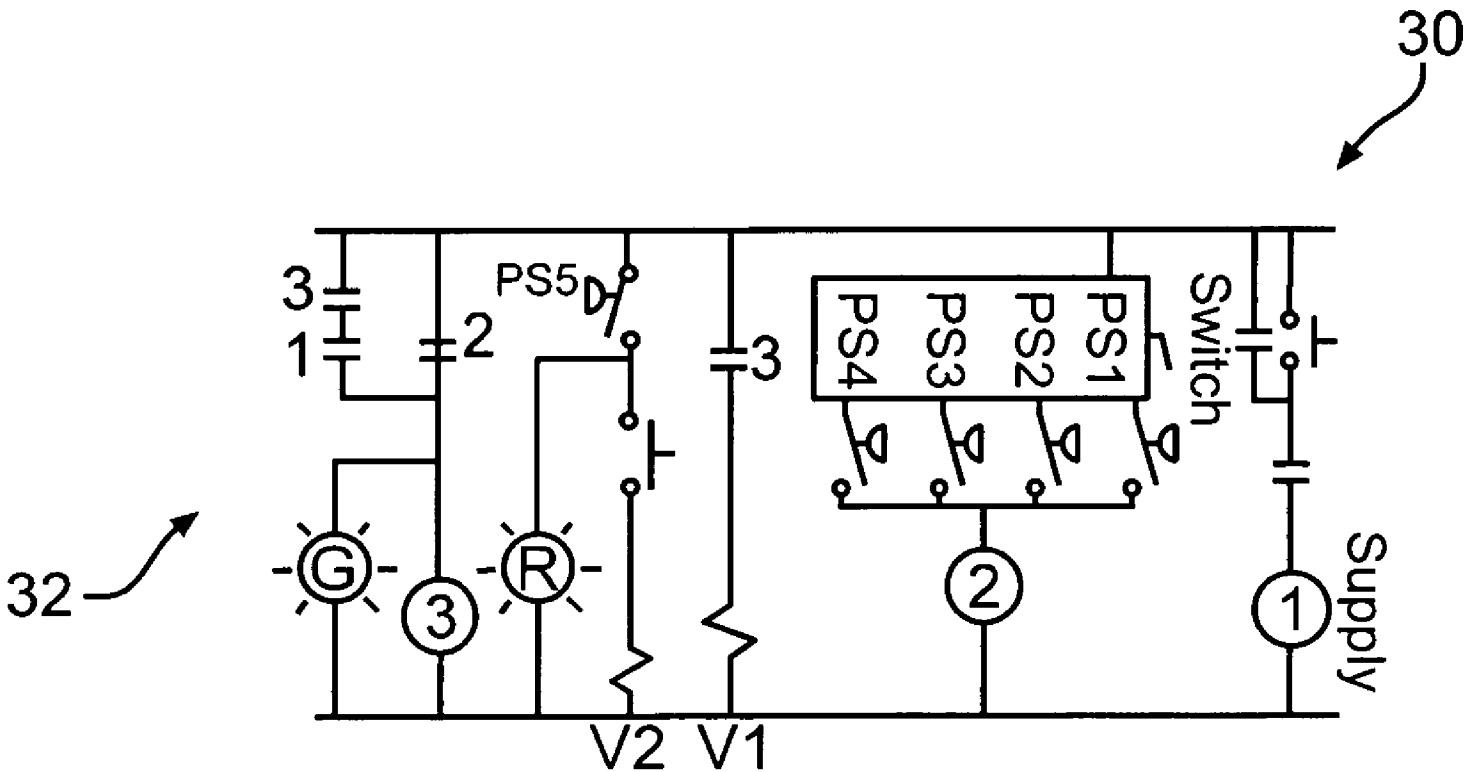
FIG. 1A is a schematic diagram of the panel control circuit 29 of the first embodiment of the inflation device 10.
Figure 2:
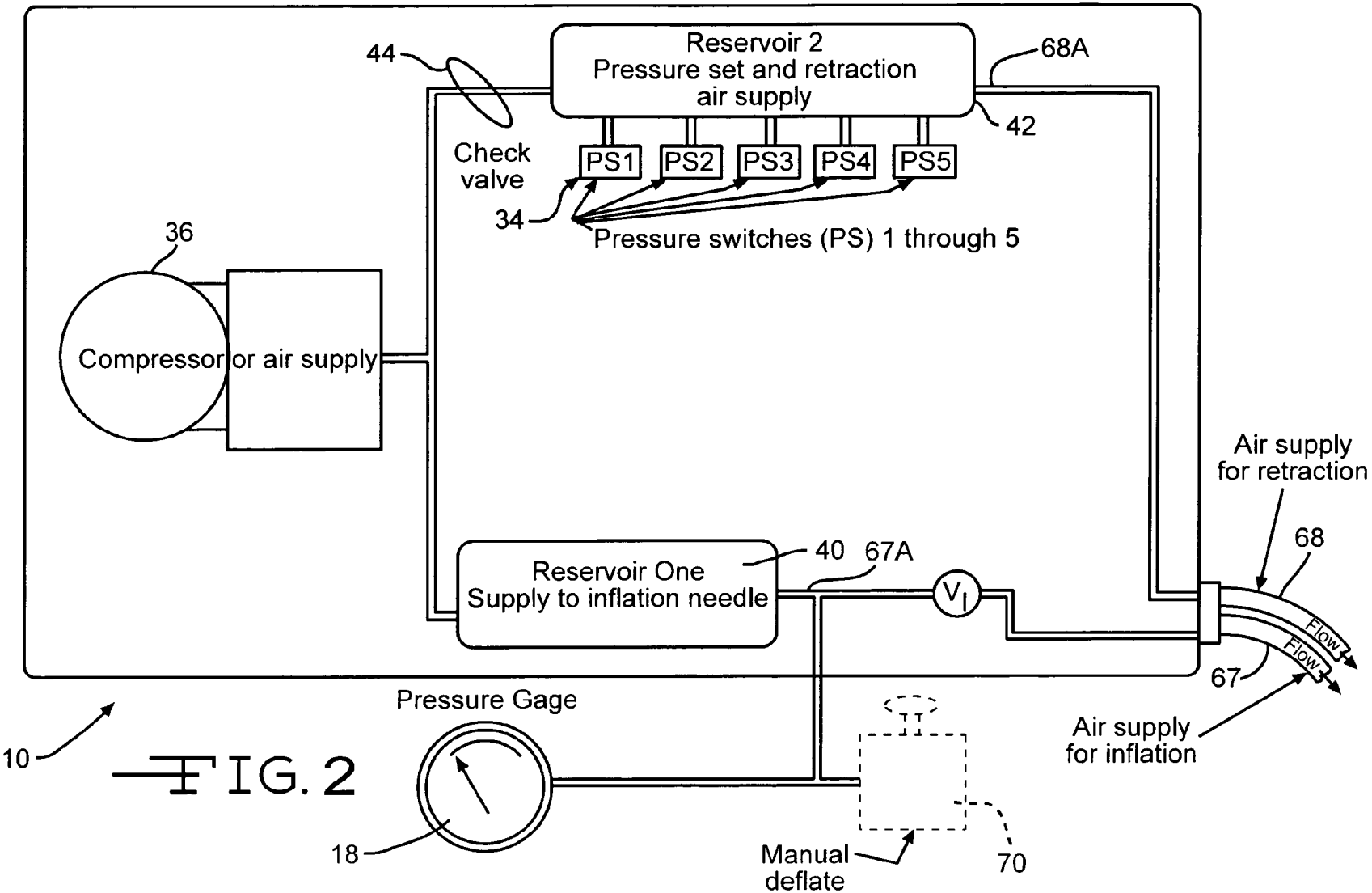
FIG. 2 is a schematic view of the various internal components of the first embodiment of the inflation device 10 including a compressor 36 as the gas supply.
Figure 3:
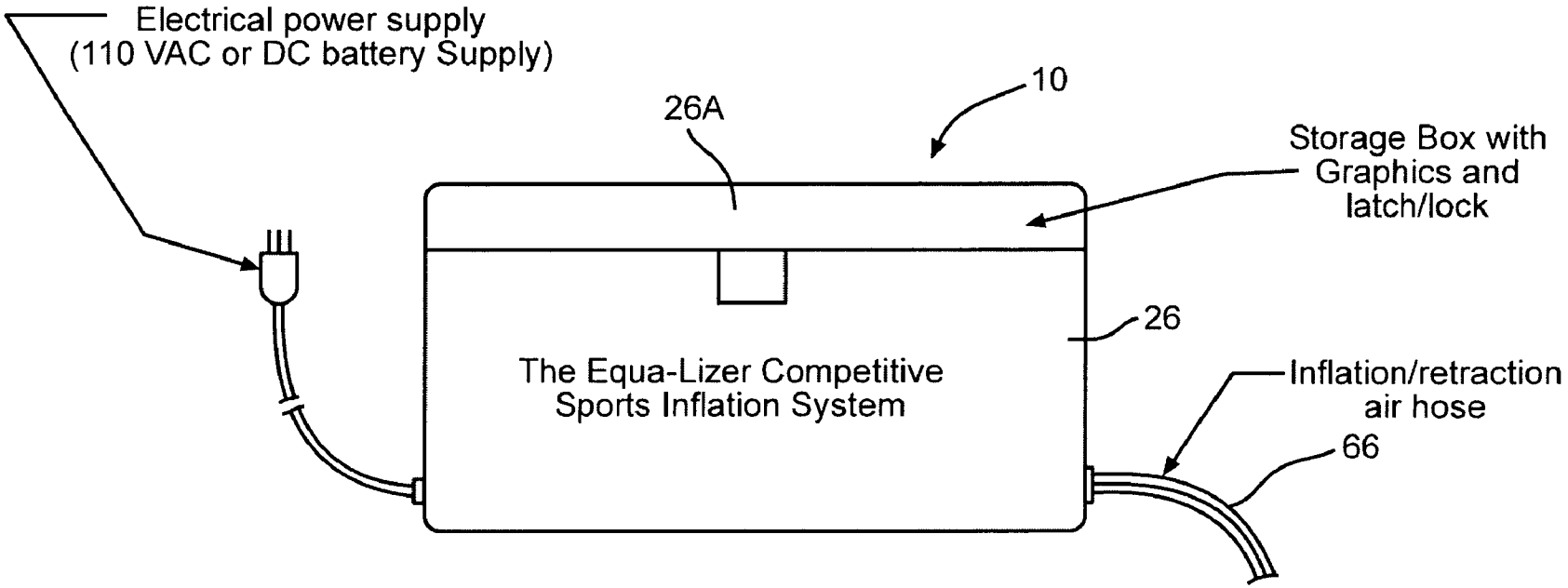
FIG. 3 is a schematic front view of the container 26 for enclosing the inflation device 10.
Figure 6:
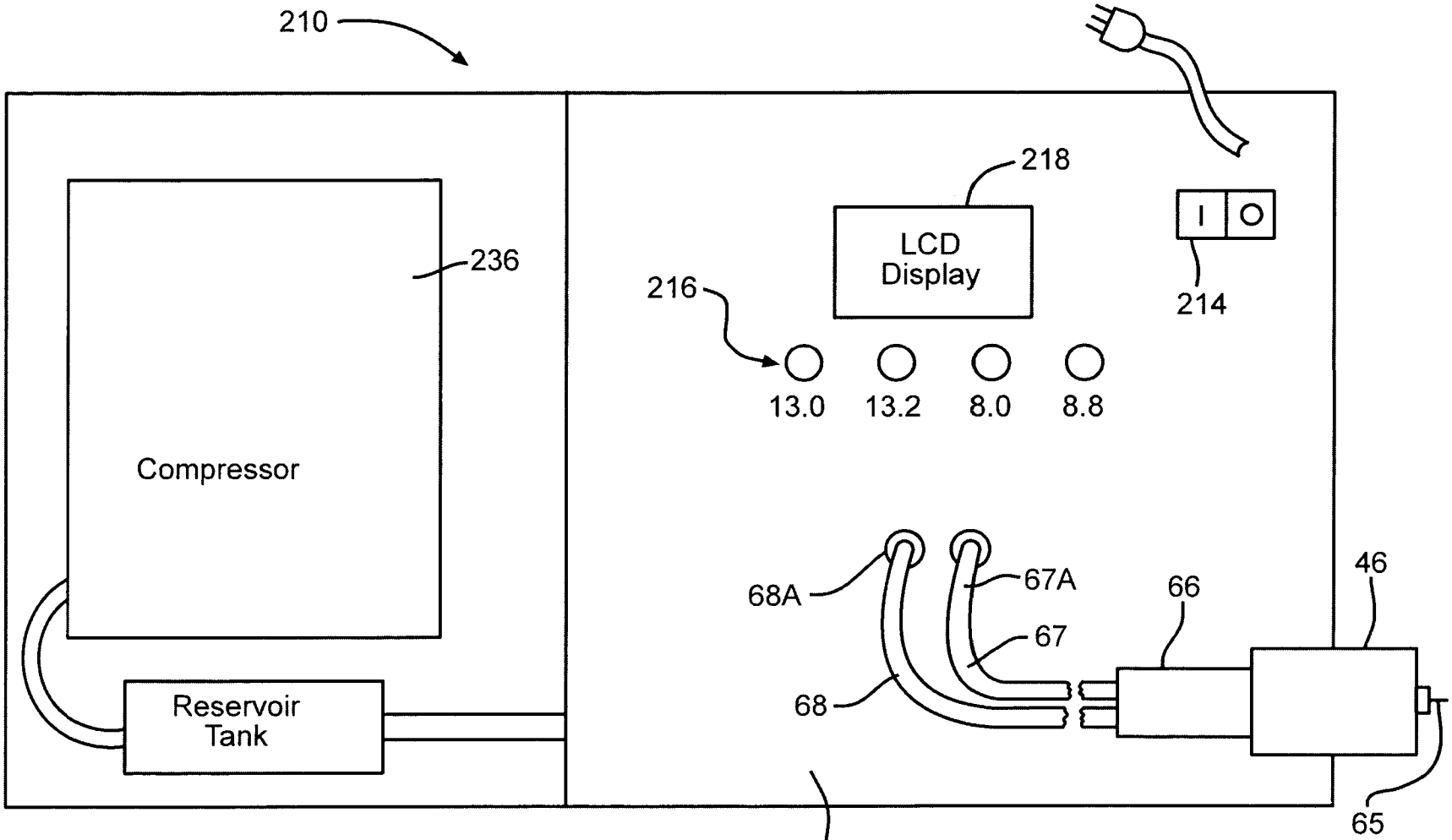
FIG. 6 is a schematic top view of the control panel 212 and compressor 236 of a second embodiment of the inflation device 210.
Figure 11:
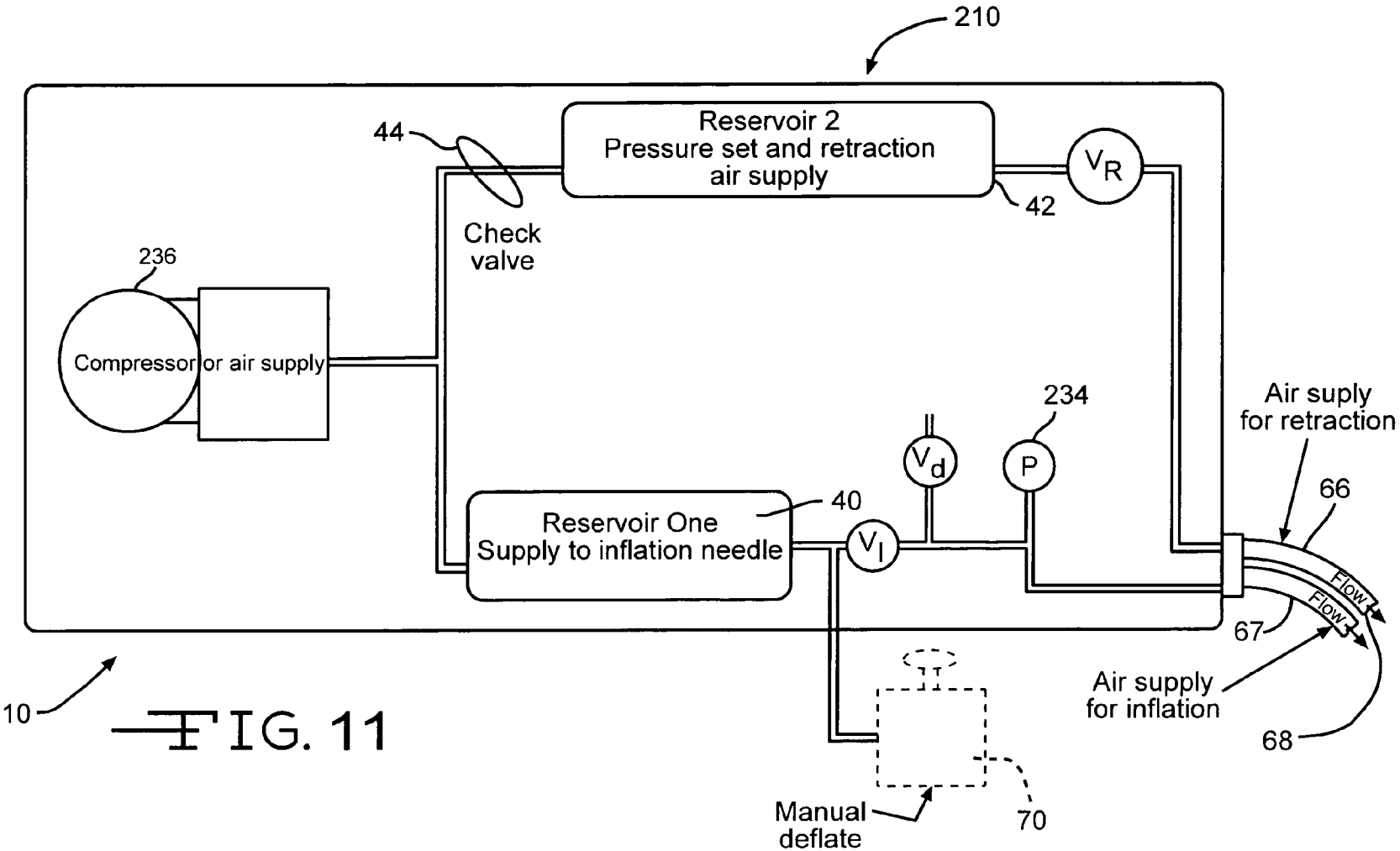
FIG. 11 is a schematic view of the various components of a second embodiment of the inflation device 210 including a compressor 236 as the gas supply means.

The present invention also provides an inflation device for inflating or deflating an inflatable object to a preselected pressure. Two embodiments of the device 10, 210 are described herein, however the present invention is not limited thereto. The device 10, 210 comprises an inflation needle 65 on an injection apparatus 46 as described above, for insertion into an inflatable object, such as a game ball 100. In some embodiments, the inflation device has more than one injection apparatus 46 so as to provide multiple ports for inflating or deflating balls or other inflatable objects. The device 10, 210 can optionally be contained within an storage container 26 as illustrated in FIG. 3. The device 10, 210 includes an inflation system comprising a gas supply means, such as a compressor 38, 236 and a gas transport hose 67 which is connected to the gas supply means. As described above, the gas transport hose 67 is connected to the inflation needle 65 to provide gas to the inflatable object. As illustrated in FIGS. 1 and 6, the inflation device 10, 210 has at least one pressure selector 16, 216 provided on a control panel 12, 212 of the device 10, 210, and one or more pressure sensors, as pressure switches 34 or an electronic pressure sensor 234, as illustrated in FIGS. 2 and 11, connected to the inflation system. FIG. 1A is a schematic diagram of the panel circuit 29 for the first embodiment of the device 10. In a second embodiment of the device 210, a control circuit 230 having a microprocessor, such as a microcontroller 232, is electrically connected to the pressure sensor 34, 234 and the microcontroller receives an electrical signal from the pressure selector 234 so as to detect the pressure of the inflation system.

Briefly, to use the device 10, 210, the inflation needle 65 is inserted by the user into the inflatable object, such as a game ball 100. A preselected pressure is selected by the user by means of the one or more pressure selectors 16, 216 on the inflation device 10, 210. The initial pressure of the inflatable object is sensed with the pressure sensors 34, 234. A pressure of the inflatable object is then adjusted by the inflation device 10, 210 so as to be essentially equal to the preselected pressure by supplying gas to or removing gas from the inflatable object. The inflation needle 65 is then retracted from the inflatable object when the pressure of the inflatable object is essentially equal to the preselected pressure.

The inflation device 10, 210 of the present invention allows for consistently inflating and/or deflating game balls 100 to a preselected pressure. The inflation device 10 and 210 can be used to inflate and/or deflate all types of inflatable game balls including footballs, soccer balls and basketballs as well as other inflatable objects. The inflation device 10, 210 includes a control panel 12, 212, at least one pressure sensor as pressure switches 34, or an electronic sensor 234, a control circuit 30, 230, a gas supply, such as a compressor 36, 236, and an injection apparatus 46. The control panel 12, 212 is electrically connected to the control circuit 30, 230. The control panel 12, 212 is used to operate the control circuit 30, 230 which controls the gas supply, such as compressor 36, 236 and the injection apparatus 46. The control panel 12, 212 includes one or more pressure selectors 16, 216. In one embodiment, the pressure selector 16 is a dial which is rotated to select the pressure. In another embodiment, the pressure selector 216 includes several pressure selection buttons 216 each representing a different pressure. In one embodiment, the control panel 12 includes an on/off switch 14, a pressure selector switch or dial 16, a pressure gauge display 18, a deflate switch 20, an over/under inflation light 22 and a competition pressure light 24, as seen in FIG. 1.

In a second embodiment of the inflation device 210, the control panel 212 includes an on/off switch 214, an LCD display 218 and a series of pressure selection buttons 216, as seen illustrated in FIG. 6. The on/off switch 214, activates the pressure sensor 234 and the control circuit 230, illustrated in FIG. 8. Power is supplied by the means of the power supply circuitry illustrated in FIGS. 10A-D. The pressure sensor 234 measures the preexisting or initial pressure in the game ball 100 and supplies gas to the injection apparatus 46 to inflate the game ball 100, or allows gas to escape the game ball 100 to deflate the game ball 100. The pressure selectors 216 allow a user to preselect a pressure to which the game ball 100 is inflated or deflated. In the first embodiment, as illustrated in FIG. 2, the control circuit 30 includes a plurality of pressure switches 34 and the selector switch 16 on the control panel 12 activates the series of switches 34 (PS1 to PS4) depending on the preselected pressure selected by the user and determines when the gas supply is activated or deactivated. In the second embodiment, the control circuit 230 includes a microcontroller 232 and the pressure selection buttons 216 to control the device 210. On the control panel 12 (FIG. 2) of the first embodiment, an over/under inflated light 22 is red and the competition pressure light 24 is green as illustrated as the lights labeled "R" (red) and "G" (green) in the panel control circuit 30 shown in FIG. 1A. In some embodiments, the pressure gauge display 18 or the LCD display 218 provides a digital readout. In other embodiments, the pressure gauge display 18 provides an analog readout.

Figure 10C:
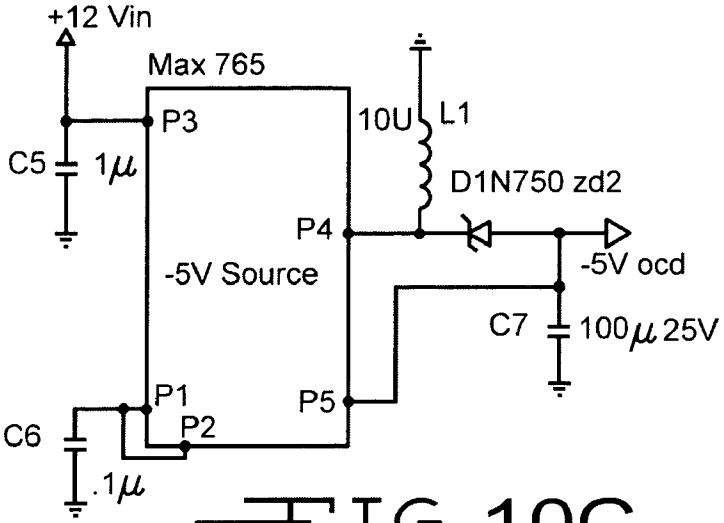
FIGS. 10A-D are schematic illustrations of some embodiments of the power supplies for the second embodiment of the device 210.
Figure 10D:
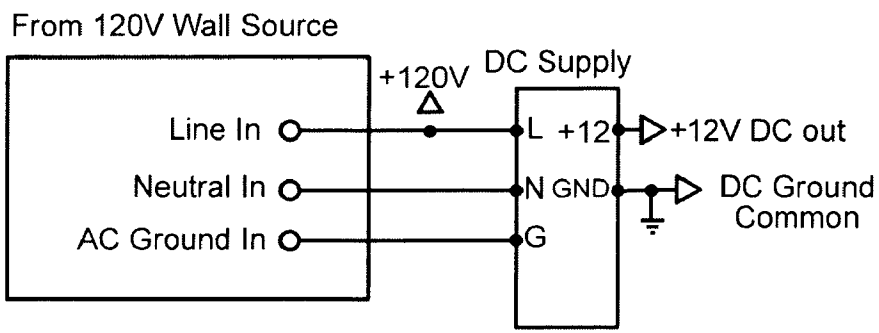
Figure 10A:
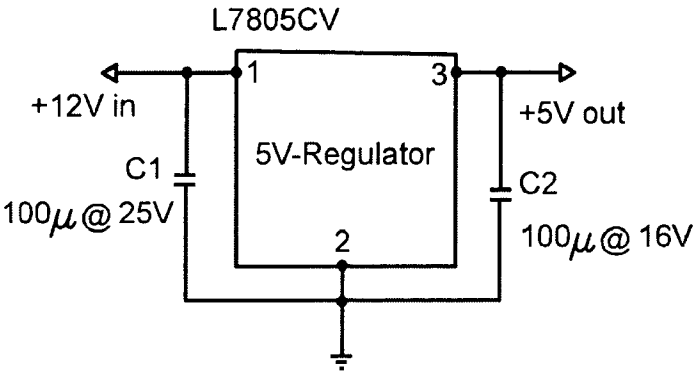
Figure 10B:
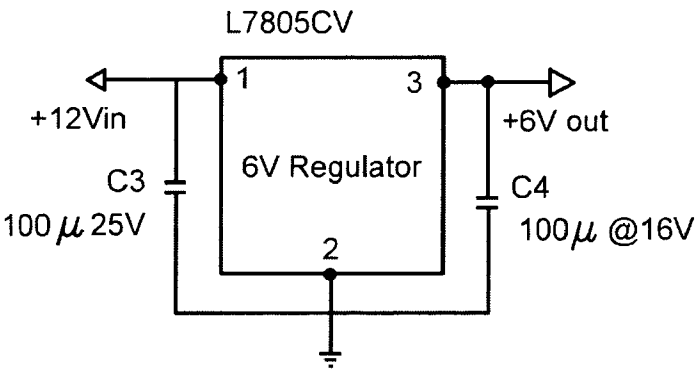

In some embodiments, as illustrated in FIG. 3, the control panel 12 and 212, the control circuit 30 or 230 and the gas supply are enclosed in a storage container 26. In some embodiments, the control panel 12, 212 forms the top of the container 26 and closes the container 26 to form an enclosed container enclosing the control circuit 30 and gas supply to protect the components from the external environment. However, in some embodiments, the container 26 has a lid 26A which covers the control panel 12, 212 and protects the control panel 12, 212 during storage. In one embodiment, the inflation device 10, 210 is powered by connection to a standard household electrical outlet, the power from the wall source is transformed by a DC power supply, such as illustrated in FIG. 10D. In another embodiment, the inflation device 10, 210 has a built-in power source such as a battery (not shown). In one embodiment, the gas supply is a compressor 36 which provides gas directly to the inflation needle 65 and the game ball 100. In another embodiment, the gas supply includes a compressor 36 and a storage reservoir tank 40, 42 to store the compressed gas created by the compressor 36. In another embodiment, the gas supply is a pre-filled tank of compressed gas (not shown) which can be removed and recharged or replaced. In this embodiment, the inflation device 10 may not have a means such as a compressor 236. In one embodiment having a pre-filled tank, the inflation device 10 does not need electricity to operate a pump. The compressed gas can be any well known gas which is non-toxic and non-flammable such as air, $CO_2$ or nitrogen.

In one embodiment, the gas supply of the inflation device 10 includes a first reservoir 40 and a second reservoir 42 in fluid communication with the compressor 36. The first reservoir 40 is spaced between the compressor 36 and the inflation needle 65. The second reservoir 42, for example an accumulator device, is spaced between the compressor 36 and the first end 68A of the retraction hose 68. In one embodiment, a one-way check valve 44 is positioned between the second reservoir 42 and the compressor 36. The check valve 44 prevents gas from leaking back from the second reservoir 42 toward the compressor 36. In one embodiment, the inflation device 10 includes a regulator which adjusts the pressure of the gas exiting the compressor 36 or storage tank to control the amount of pressure used for inflating the game ball 100.

The injection apparatus 46, best seen in FIGS. 5A and B, has a first end 46A and a second end 46B which is placed against the game ball 100. The injection apparatus 46 has an outer housing 47 with an outer wall 49 extending from a first end 49A to a second end 49B defining a center bore 46C therebetween. The first end 46A of the injection apparatus 46 has a top wall 48 with an opening 48A allowing access to the center bore 46C. In one embodiment, a second end 46B of the injection apparatus 46 is open. In another embodiment, a bottom wall (not shown) extends across at the second end 46B of the injection apparatus with an opening allowing access to the center bore 46C. An inner wall 52 extends completely across the center bore 46C between the first end 49A and the second end 49B of the outer wall 49 of the injection apparatus 46. The inner wall 52 has an opening 52A which is aligned with the opening 48A in the top wall 48. An inner chamber 54 is formed between the top wall 48 of the injection apparatus 46 and the inner wall 52 of the injection apparatus 46. A post 56 having first and second ends 56A and 56B with an inner passageway 56C extending therebetween is slidably mounted in the center bore 46C of the injection apparatus 46 through the openings 48A and 52A in the top wall 48 and the inner wall 52. In one embodiment, the openings 48A and 52A have seals 57 and 59 which form a sealing fit between the outer surface of the post 56 and the openings 48A and 52A to seal the inner chamber of the injection apparatus 46 against leakage of gas. In one embodiment, the seals 57 and 59 are o-rings.

A piston 62 is mounted on the outer surface of the post 56 such that when the post 56 is mounted in the center bore 46C of the injection apparatus 46, the piston 62 is positioned in the inner chamber 54 of the injection apparatus 46 between the top wall 48 and the inner wall 52 of the injection apparatus 46. The piston 62 has a shape and size similar to the shape and size of the center bore 46C of the injection apparatus 46. In one embodiment, the center bore 46C of the injection apparatus 46 has a cylindrical shape and the piston 62 has a circular or cylindrical shape, however the present invention is not limited thereto. In this embodiment, the outer diameter of the piston 62 is slightly less than the diameter of the center bore 46C of the injection device 46 such that the piston 62 is able to slide or move along the center bore 46C. An outer surface of the piston 62 is only slightly spaced apart from the sidewall of the center bore 46C. In one embodiment, the outer surface of the piston 62 is provided with a seal 63 which provides a seal between the outer surface of the piston 62 and the sidewall of the center bore 46C to form a sealed chamber 64 between the piston 62 and the inner wall 52 of the injection apparatus 46. In one embodiment, the seal 63 is an o-ring.

The sidewall of the post 56 has a hole 56D spaced between the ends 56A and 56B of the post 56. When the post 56 is positioned in the center bore 46C of the injection apparatus 46, the hole 56D is spaced between the inner wall 52 of the injection apparatus 46 and the piston 62, adjacent to and below the piston 62. In one embodiment, the first end 56A of the post 56 has a top wall 58 with an opening to allow access to the inner passageway 56C. In another embodiment, the first end 56A of the post 56 is open (not shown) to allow full access to the inner passageway 56C. The second end 56B of the post 56 has a bottom wall 60 with an opening 60A. The inflation needle 65 or other inflation adaptor is mounted in the opening 60A in the bottom wall 60 of the post 56. In one embodiment, the inflation needle 65 is removable such that the inflation needle 65 can be easily replaced if damaged or can be easily exchanged for another type of inflation adaptor to allow inflation of different objects. In one embodiment, the inflation needle 65 is similar to a standard inflation needle used to inflate game balls 100.

The injection apparatus 46 is connected to the gas supply by an inflation hose 66 (FIG. 3). The inflation hose 66 extends from the gas supply through the opening in the top wall 58 of the post 56 into the inner passageway 56C of the post 56. The inflation hose 66 includes a gas transport hose 67 and a retraction hose 68. In one embodiment, the gas transport hose 67 and the retraction hose 68 are joined together in a single outer cover to form the inflation hose (not shown). As seen in FIG. 2, the first end 67A of the gas transport hose 67 is connected to the compressor 36 or storage tank, if present, or first reservoir 40, if present. The first end 67A of the gas transport hose 67 is also in fluid communication with the pressure gauge 18 or the pressure sensor 234. The pressure gauge 34 or pressure sensor 234 is spaced between the compressor 36 and the inflation needle 65 or between the first reservoir 40 and the inflation needle 65.

The gas transport hose 67 extends from the first end 67A through the inner passageway 56C of the post 56 to the bottom wall 60 of the post 56. In the embodiment having the first reservoir 40, the first reservoir 40 is spaced between the gas supply and the inflation needle 65. The second end 67B of the gas transport hose 67 is connected to the inflation needle 65 at the second end 56B of the post 56 such that the inflation needle 65 is in fluid communication with the gas transport hose 67, the pressure gauge 34 or pressure sensor 234, and manual or automatic deflation valve 70, if present, and the gas supply. The gas transport hose 67 allows gas to move from the gas supply, through the injection apparatus 46 and through the inflation needle 65 into the game ball 100. In one embodiment, as illustrated in FIG. 2, a flow control valve $V_1$ is located in the gas transport hose 67 between the gas supply and the inflation needle 65 or between the first reservoir 40 and the inflation needle 65. The flow control valve 72 enables the user to achieve control of the supply of gas to the game ball 100 during inflation.

The first end 68A of the retraction hose 68 is connected, directly or through a reservoir 42, such as a pneumatic accumulator, to the gas supply. The retraction hose 68 extends from the gas supply into the inner passageway 56C of the post 56 and the second end 68B of the retraction hose 68 is connected to the hole 56D in the sidewall of the post 56. The retraction hose 68 is in fluid communication with the gas supply or reservoir and the sealed chamber 64 spaced between the piston 62 and the inner wall 52 of the injection apparatus 46. In the embodiment where the inflation device 10 or 210 includes a manual deflation valve 70, the manual deflation valve 70 is positioned between the gas supply and the inflation needle 65 downstream of the pressure gauge 34 or pressure sensor 234. In the embodiment having the check valve 44 positioned between the gas supply and the second reservoir 42, the check valve 44 prevents gas from escaping from the sealed chamber 64 of the injection apparatus 46 through the second reservoir 42. In Bone embodiment (not illustrated), the inflation device 10 or 210 has several inflation pistons 62 connected to one or more inflation hoses 66 to enable several game balls 100 to be inflated simultaneously to the same preselected pressure. In one embodiment, the injection apparatus 46 is constructed of a plastic material. However, it is understood that the injection apparatus 46 can be constructed of any durable, lightweight material that is non-porous.

The inflation device 10 or 210 can be used to inflate or deflate a variety of different types of game balls 100 or inflatable objects to a preselected pressure. To use the inflation device 10 or 210 to inflate or deflate a game ball 100 to a preselected pressure, the user activates the inflation device 10 or 210 using the on/off switch 14. In the embodiment where the gas supply uses a compressor 36 and a storage tank, when the inflation device 10 is activated, the compressor 36 operates to fill the storage tank. The compressor 36 automatically deactivates when the storage tank 38 is full and automatically reactivates when the storage tank 38 begins to empty. In one embodiment, when the inflation device 10 is activated, gas is moved from the storage tank (not illustrated) or pre-filled tank into the first and second reservoirs 40 and 42. Next, the user sets the pressure selector 16, 216 on the control panel 12, 212 to the preselected pressure corresponding to the desired pressure.

The pressure selector 16 or 216 allows the inflation device 10 to be used to inflate or deflate game balls 100 to different inflation pressures as selected by the user. Once the desired pressure is selected, the inflation needle 65 is moved into the extended position and inserted into the inflation valve 102 of the game ball 100 (FIG. 4A). It is understood that the desired pressure can be selected after the inflation needle 65 is inserted into the game ball 100. To move the inflation needle 65 into the extended position, the user pushes on the first end 56A of the post 56 to move the post 56 along the center bore 46C of the injection apparatus 46 and to move the inflation needle 65 out of the center bore 46C of the injection apparatus 46 and past the second end 49B of the outer wall of the injection apparatus 46. The needle 65 can be automatically retracted by the device 10, 210 into the injection apparatus 46 after the inflation device 10 is deactivated. The user can hold the game ball 100 during insertion of the needle 65 into the inflation valve 102. However, the game ball 100 can also be placed in a holder which maintains the game ball 100 in a set position. The user can continue to hold the ball 100 during the inflation or deflation of the game ball 100. The inflation needle 65 can be inserted into the inflation opening 102 of the game ball 100 before the gas supply is charged or activated. However, the inflation needle 65 can be inserted into the game ball 100 after the gas supply is charged or activated provided there is a valve between the gas supply and the inflation needle 65 which prevents the gas in the gas supply from entering the inflation needle 65.

Once the inflation needle 65 is fully and correctly inserted into the inflation opening 102 of the game ball 100, the initial pressure of the game ball 100 is measured through the gas transport hose 67 using the pressure gauge 34 or pressure sensor 234 and displayed on the pressure gauge display 18 or display 218. In one embodiment, the initial pressure of the game ball 100 is measured using a pressure transducer. However, it is understood that any pressure measuring device well known in the art can be used to measure the pressure in the game ball 100 and to provide a readout of the pressure. In one embodiment, if the initial pressure of the game ball 100 is greater or less than the desired pressure as preselected by the user, then the over/under inflated light 22 illuminates. If the game ball 100 is over inflated, gas is released from the game ball 100 until the pressure of the game ball 100 is essentially equal to the preselected pressure. In one embodiment, the user activates the deflation switch 20 on the control panel 12 which activates the PS5 switch 32 of the control circuit 30 to automatically deflate the game ball 100 to a pressure essentially equal to the preselected pressure. In another embodiment, the user manually deflates the game ball 100 by opening a valve in the gas transport hose 67 which allows gas in the game ball 100 to be released. The user continues to release the gas in the game ball 100 until the pressure shown on the pressure gauge display 18 is essentially equal to or less than the preselected pressure. In the second embodiment having the microcontroller 232, the inflation device 210 automatically opens a valve $V_l$, $V_d$ in the gas transport hose 67 which allows gas to enter/exit the game ball 100 through the gas transport hose 67. The pressure of the game ball 100 is continuously sensed and when the pressure of the game ball 100 is essentially equal to the preselected pressure, the inflation device 10 or 210 closes the valve $V_l$, $V_d$ displays the pressure of the game ball 100 on the pressure gauge display 18 or LCD display 218 and retracts the inflation needle 65 into the injection apparatus 46. In one embodiment, the game ball 100 is deflated to between about 2 and 2.5 PS1 (14 and 17.5 kPa) below the preselected pressure.

If the initial pressure of the game ball 100 is less than the preselected pressure or if the game ball 100 is deflated by the inflation device 10 or 210 to less than the preselected pressure, the inflation device 10 or 210 acts to move gas from the gas supply through the gas transport hose 67 into and through the inflation needle 65 and into the game ball 100. In one embodiment, the gas is moved from the first reservoir 40 through the gas transport hose 67 and into the game ball 100. As the gas is moved into the game ball 100, the pressure of the game ball 100 is continually measured. In one embodiment, the pressure of the game ball 100 is continuously displayed on the pressure gauge display 18 or LCD display 218. The gas is moved into the game ball 100 until the pressure of the gas in the game ball 100 is essentially equal to the preselected pressure. The inflation device 10 is accurate to less than 0.5 PS1 (3.5 kPa). In one embodiment, the inflation device 10 inflates the game ball 100 to between about 0.1 to 0.3 PS1 (0.7 to 2.1 kPa) greater or less than the preselected pressure. In one embodiment, the pressure shown on the pressure gauge display 18 or LCD display 218 during-inflation is slightly greater than the actual pressure of the gas in the game ball 100 due to back pressure. In one embodiment, once the game ball 100 is inflated to the correct preselected pressure, the competition pressure light 24, if present, is turned "on", the gas supply is turned "off" or a valve between the storage tank 38 or the pre-filled tank and the inflation needle 65 is closed and the selector switch 16 activates the switches or relays (PS1 to PS4) 32 to turn the inflation device 10 off or deactivate the compressor 36 or other gas source and to activate and then open the retraction hose 68 to retract the inflation.

In the second embodiment, once the pressure of the game ball 100 is essentially equal to the preselected pressure, the microcontroller 232 retracts the inflation needle 65 from the game ball 100 and deactivates the gas supply. In one embodiment, the inflation needle 65 is automatically retracted into the injection apparatus 46 when the inflation device 10 is deactivated. To retract the inflation needle 65, gas from the gas supply or from the second reservoir 42, if present, is moved through the retraction hose 68 to the injection apparatus 46. The gas moves through the retraction hose 68 through the hole 56D in the post 56 and into the sealed chamber 64 between the inner wall 52 of the injection apparatus 46 and the bottom 60 of the piston 62. As the gas is moved into the sealed chamber 64, the pressure of the gas on the bottom of the piston 62 pushes the piston 62 towards the top wall 48 of the injection apparatus 46. As the piston 62 moves upward, the post 56 moves upward and the inflation needle 65 mounted on the second end 56B of the post 56 is retracted into the center bore 46C of the injection apparatus 46. As the inflation needle 65 moves into the center bore 46C of the injection apparatus 46, the second end 49B of the outer wall of the injection apparatus 46 contacts the game ball 100 and removes the inflation needle 65 from the game ball 100. Once the inflation needle 65 is fully retracted, the inflation device 10 or 210 can be deactivated. In another embodiment, power to the inflation device 10 is cut as soon as the game ball 100 is correctly inflated and the competition pressure light 24 illuminates. Upon cutting of the power to the device 10, the retraction switches (PS1 to PS4) 32 are flipped to retract the inflation needle 65. In this embodiment, the retraction of the inflation needle 65 is caused by the force of the compressed gas escaping from the second reservoir 42 into the sealed chamber 64. In one embodiment, the amount of gas stored in the second reservoir 42 is only slightly greater in volume than the volume of the sealed chamber 64.

As described above a first embodiment of the inflation device 10 uses pressure switches 32 (PS1, PS2, PS3, PS4, and PS5) to control the pressure in the hydraulic system. The second embodiment of the device 210 is illustrated in FIGS. 6, 8, 9 and 11. The second embodiment of the inflation device 210 utilizes the same injection apparatus 46 as described above. However, this embodiment of the inflation device 210 does not use pressure switches 32 to control the pressure in the hydraulic system. In the second embodiment, the pressure is controlled by a microprocessor, preferably a microcontroller 232, to adjust the pressure of the inflatable object by inflation valves Vi and deflation valve Vd. The needle 65 is then retracted from the inflatable object by opening the retract valve Vr.

Figure 8:
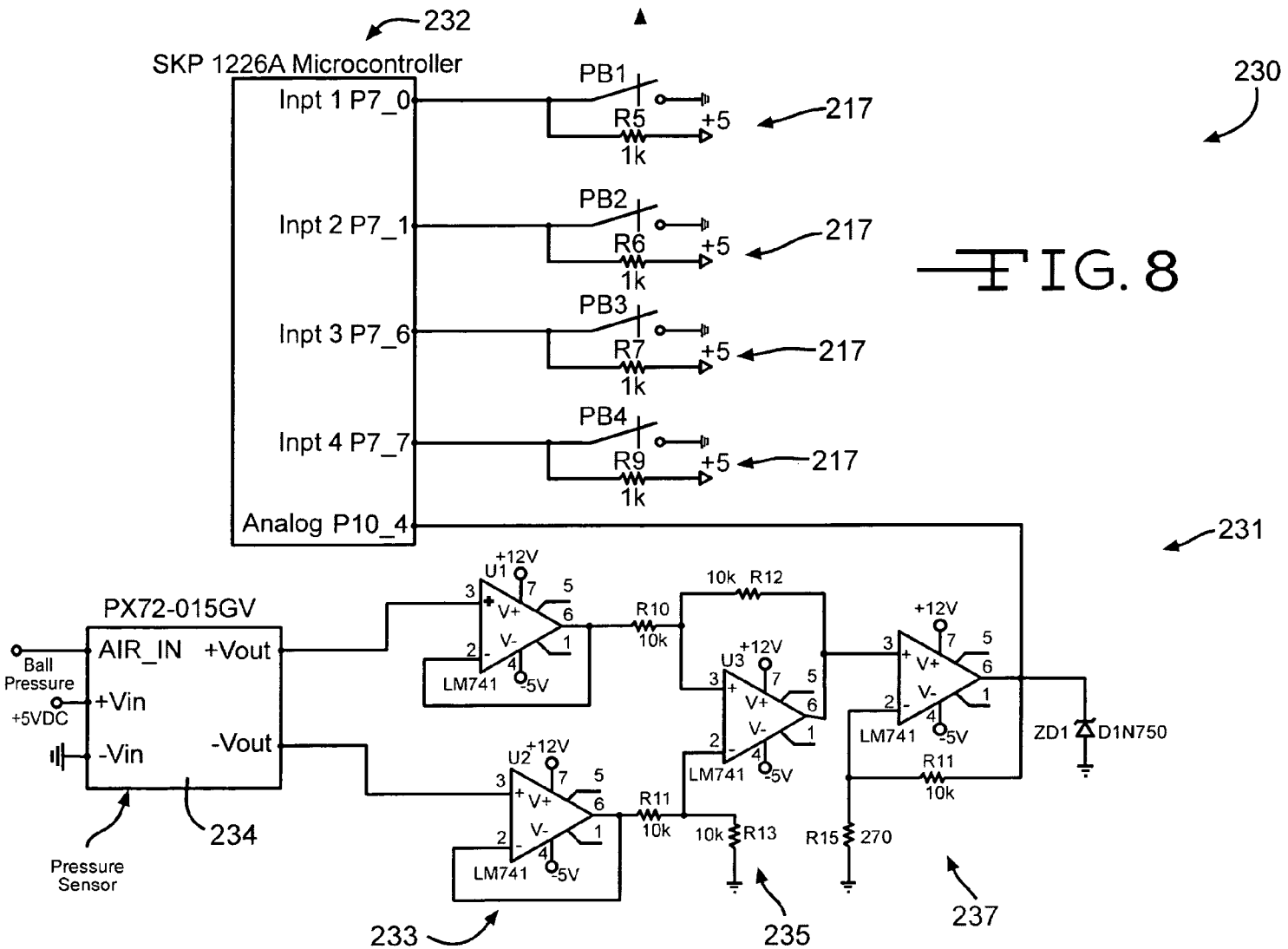
FIG. 8 is one embodiment of a circuit diagram of an input portion of the control circuit 230 for the microcontroller 232 for the second embodiment of the device 210.
Figure 9:
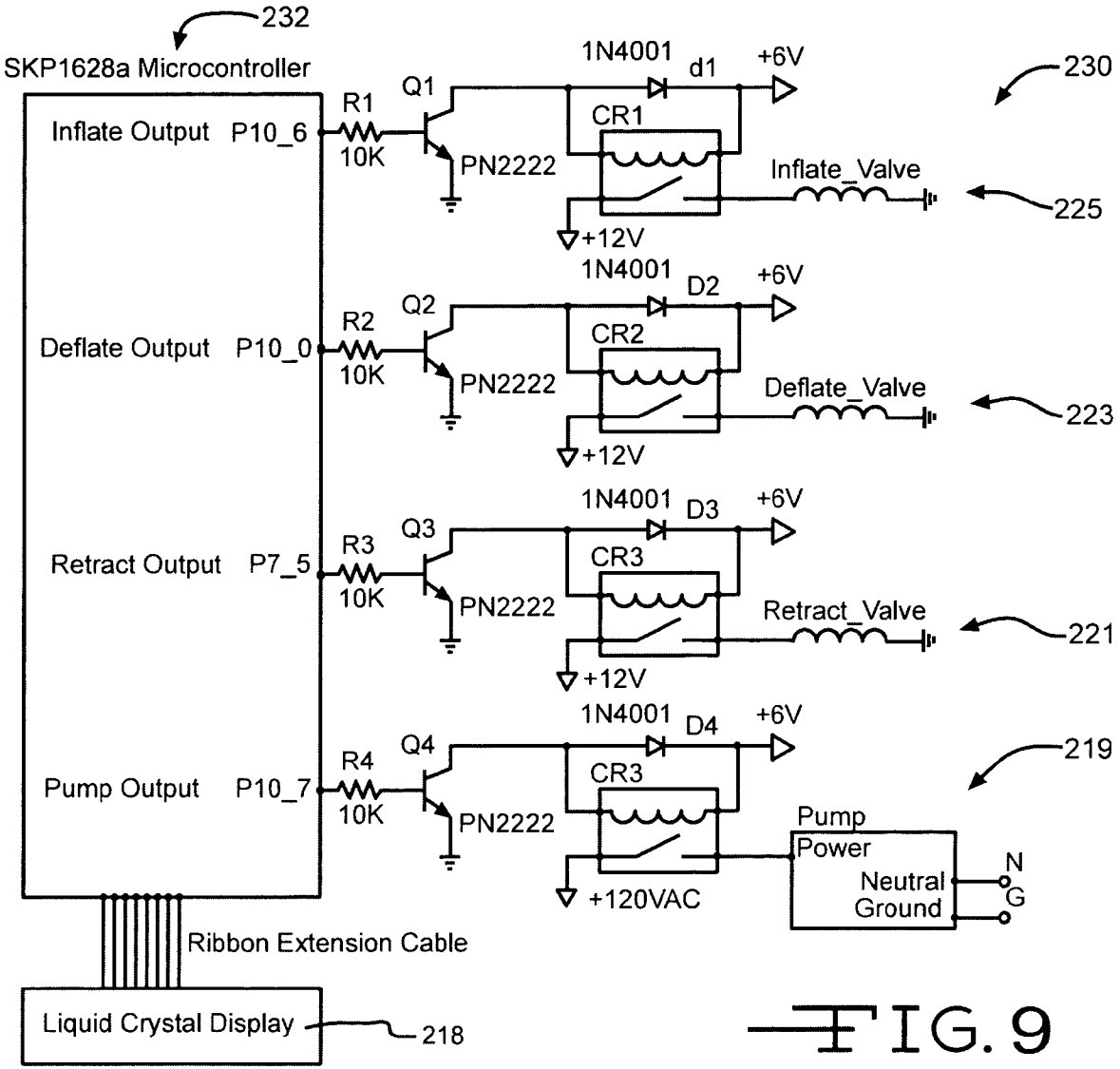
FIG. 9 is one embodiment of a circuit diagram of an output portion of the control circuit 230 for the microcontroller 232 for the second embodiment of the device 210.

The control circuit 230 for the second embodiment of the inflation device 210 is illustrated in FIG. 8 and FIG. 9. FIG. 11 illustrates the internal components of the system that are controlled by the control circuit. The input portion of the control circuit 230 is schematically illustrated in FIG. 8. As seen in FIG. 8, the ball pressure is measured at the AIR IN tube fitting of a PX72-015GV PC board mountable piezoelectric pressure sensor 234 (Omega.com, Stamford, Conn.) powered by a +5 V DC input at Vin to supply a voltage difference across +V out and −V out. The pressure sensor 234 ("P" as seen illustrated in FIG. 11) is attached in the hydraulic system in the second embodiment of the device 210 to detect pressure in the inflatable object. The output of the pressure sensor 234 is amplified by an amplifier circuit 231, as seen schematically illustrated in FIG. 8. Operational amplifiers, such as two LM741A op amps, are configured as two voltage followers 233 to provide buffers for the +V out and −V out outputs. The outputs of the two voltage followers are supplied to a differential amplifier subcircuit 235 constructed with an operational amplifier, such as LM741. The resistors R10, R11, R12 and R13 each have a resistance of 10 kΩ to provide a difference output at the differential amplifier. The difference output is fed into an operational amplifier, such as LM741, configured as a non-inverting amplifier 237. The output of the non-inverting amplifier is provided as an analog input (Analog P10_4) to the SKP 1526A microcontroller 232. Each of the LM741 operational amplifiers are supplied by a +12V power supply, illustrated in FIG. 10D, and a −5V power supply powered from the +12V power supply, as illustrated in FIG. 10C. The microcontroller 232 then sends a signal by a ribbon extension cable to the liquid crystal display 218 mounted on the control panel 212, as illustrated in FIGS. 6 and 9, to display the current pressure on the display 218. The SKP 1526A microcontroller 232 also accepts four other inputs as illustrated in FIG. 8 that allow the user to preselect the desired pressure for the inflatable object. Each of the four pressure selection buttons 216 mounted on the control panel, as illustrated in FIG. 6, when pressed closes an electrical switch 217 (PB1, PB2, PB3, PB4) electrically connected to input pins (at inputs Inpt 1 P7_0, Inpt 2 P7_1, Inpt 3 P7_6, and Inpt 4 P7_7) on the micro-controller 232. Thus, the microcontroller 232 can be programmed by means of the four pressure selection buttons 216 to adjust the inflatable object, such as a game ball 100, to a preselected pressure.

The output portion of the control circuit 230 is schematically illustrated in FIG. 9. As seen in FIG. 9, a pump output 219 (at P10_7) controls the pump power. The inflation valve Vi, as illustrated in FIG. 11, is controlled at the inflate output (P10_6) of the microcontroller 232. As seen illustrated in the flowchart of FIG. 7, if the microcontroller 232 detects from the analog input (analog P10_4) from the PX72-015GV pressure sensor 234 that the pressure of the system is low, then the inflation valve Vi is activated by the microcontroller 232. The deflate valve 223 is controlled at the deflate output (at P10_0) of the microcontroller 232. As seen illustrated in the flowchart of FIG. 7, if the microcontroller 232 detects from the analog input (analog P10_4) from the PX72-015GV pressure sensor 234 that the pressure of the system is high, and the game ball must be deflated, then the deflation valve Vd, as illustrated in FIG. 11, is activated by the microcontroller 232. The retract valve 221 is controlled at the retract output (at P7_5) of the microcontroller 232. As seen illustrated in the flowchart of FIG. 7, if the microcontroller 232 detects from the analog input (analog P10_4) from the PX72-015GV pressure sensor 234 that the game ball is at the preselected pressure setting, then a signal from the retract output (P7_5) of the microcontroller 232 activates the retract valve Vr, as illustrated in FIG. 11, to remove the needle 65 of the injection apparatus 46 (FIGS. 4A, B, and FIGS. 5A, B) from the inflatable object, such as game ball 100. The microcontroller 232 also sends a signal at the pump output 219 (at P10_7) to turn the pump power off. Each of the output circuits (219, 221, 223, 225) are powered by the six volt regulator illustrated in FIG. 10B.

Figure 7:
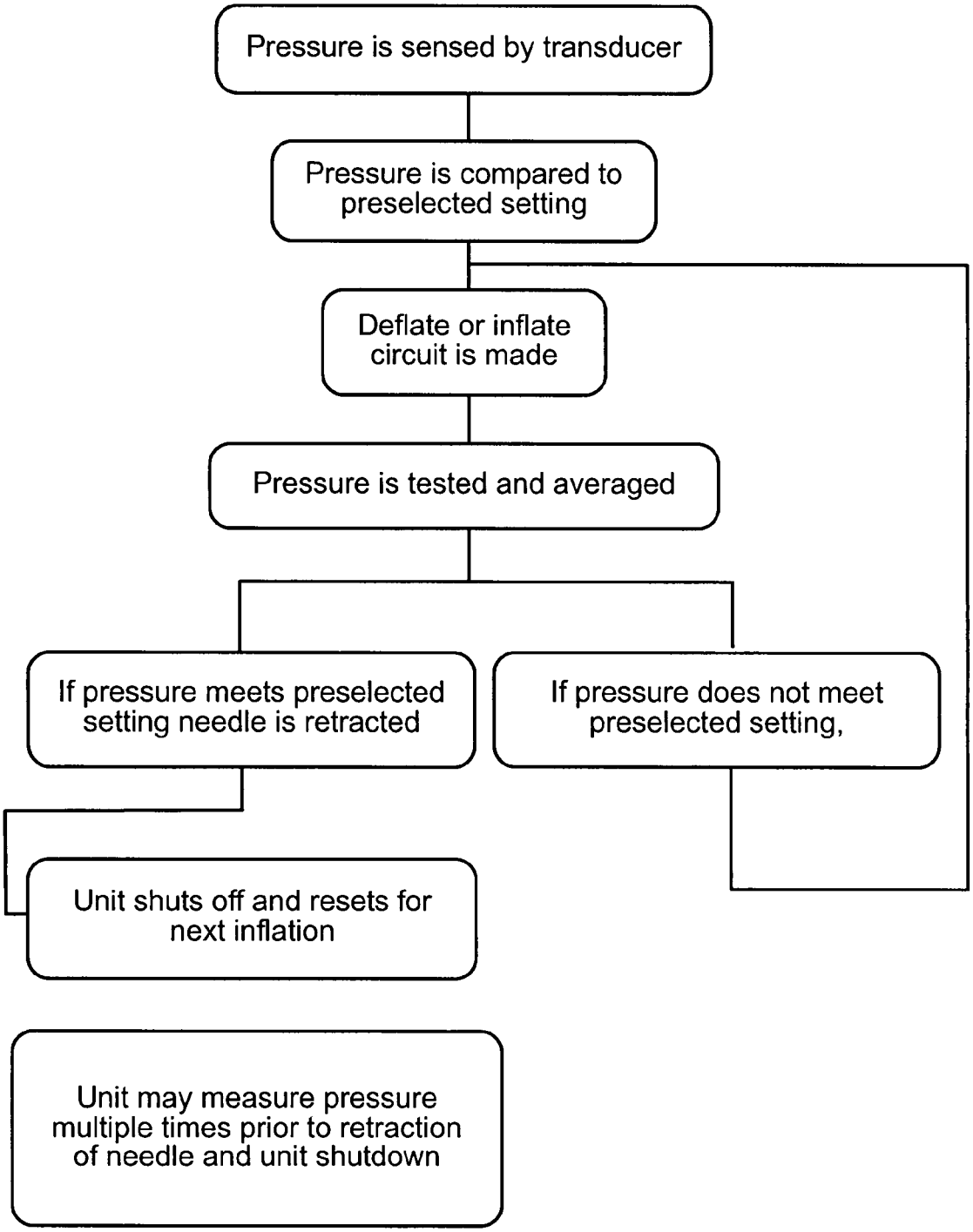
FIG. 7 is a flow chart showing the steps for inflating or deflating a game ball 100 to a preselected pressure using the inflation device 10 or 210.

Therefore, as seen illustrated in the flowchart of FIG. 7, the microcontroller 232 is programmed so that the following logic is performed. The pressure of the system is detected by a transducer, such as the pressure sensor. This pressure is compared to a preselected pressure setting, as set by means of a dial or pressed buttons. A command from the microcontroller is made to a deflate valve Vd or an inflate valve Vi to deflate or inflate the game ball by means of the output circuit of the control circuit 230 as schematically illustrated in FIG. 9. The pressure of the inflatable object is then tested and averaged by the microcontroller 232. If this pressure does not meet the preselected pressure setting, then the cycle is repeated until the pressure meets the preselected pressure setting. Once the pressure is determined by the microprocessor, such as microcontroller 232, to meet the preselected pressure setting, a command is sent by the microcontroller 232 by means of the output circuit illustrated in FIG. 9 to open the retract valve Vr. Once the retract valve Vr is open, gas is provided to the retraction hose 68. The gas passes through the retraction hose 68 to the chamber 64 of the injection apparatus 46, between the piston 62 and the inner wall 52 of the injection apparatus 46, illustrated in (FIGS. 4A, B, and FIGS. 5A, B). When the gas is supplied to the retraction hose 68, the pressure in the chamber 64 forces the housing 47 down against the game ball 100, so as to remove the inflation needle 65 from the game ball 100. After opening the retract valve Vr, the microcontroller 232 shuts of the power to the pump of the inflation device at the pump output 219. The unit shut off and reset for the next inflation.

A third embodiment of the device 310, as illustrated in FIGS. 12 through FIG. 20, is a second generation prototype of the inflation device of the present invention. The device 310 can inflate any inflatable object, such as a sports ball 100, to a desired pressure and then automatically withdraws the needle 65 of the injection apparatus 65 (FIGS. 4A, 4B 5A, and 5B). The device 310 offers a high level of pressure accuracy (within 0.1 pounds per square inch) and also minimizes the air lost when removing the needle 65. The second generation prototype inflation device 310 includes a printed control circuit 330 board that contains all of the electronics with the exception of the power supply. A liquid crystal display 318 was selected that is larger and easier to read, and also includes a backlight. The coding for the PIC microcontroller 332 was written to make the device 310 more user friendly. This was done by stepping the user through the operation steps as well as giving the user more options that they can choose from. These additional options include an adjustment step where the user can change the pressure by increasing or decreasing the pressure level in tenths of pound increments by pressing the "+" or "−" buttons, respectively, on the control panel 312 illustrated in FIG. 12.

Figure 12:
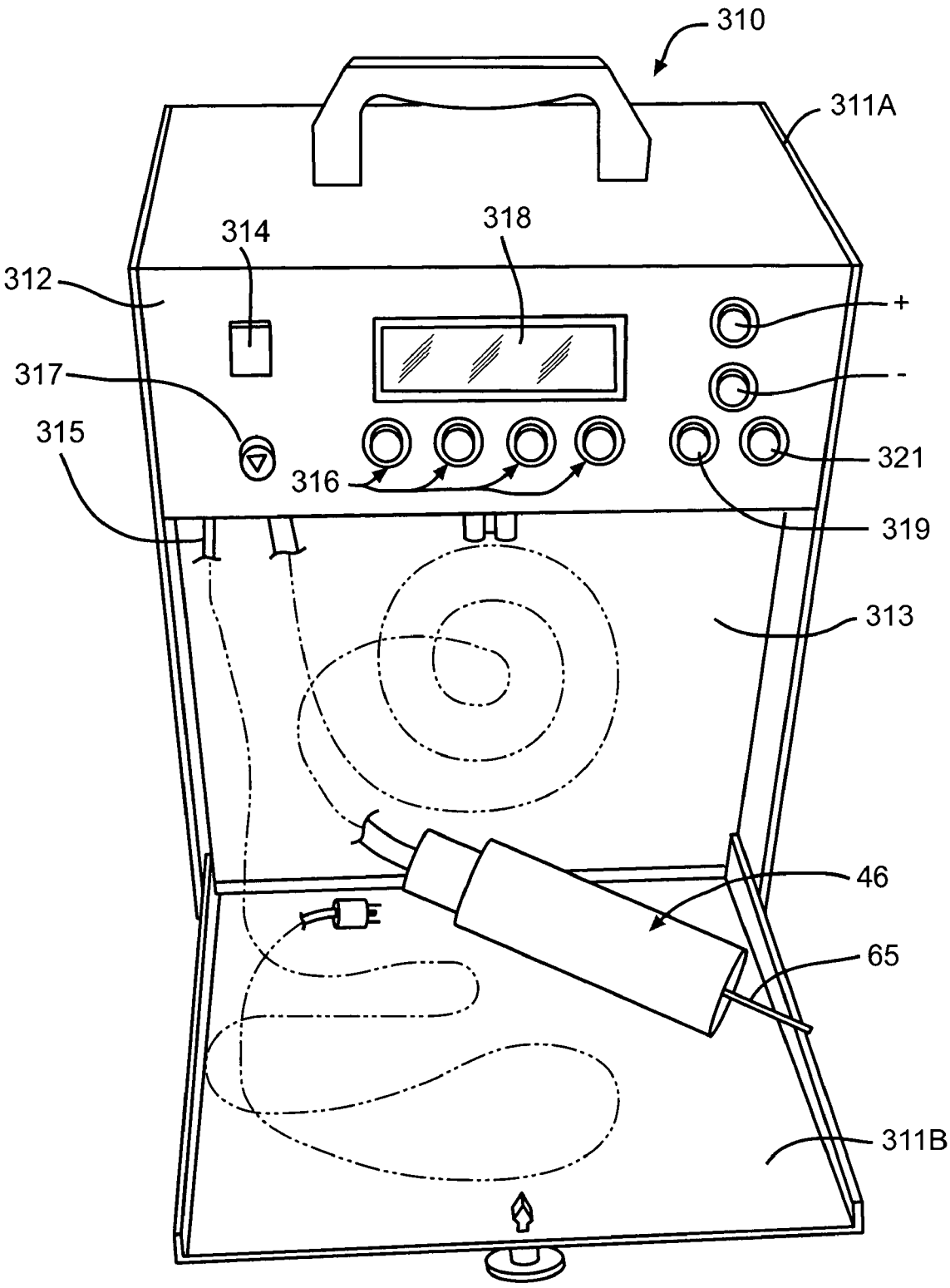
FIG. 12 is a front view of a third embodiment of the inflation device 310 with the front door 311B of a compartment 313 opened to expose the inflation apparatus 46. The front panel 312 of the device 310 includes a user interface and button format.
Figure 19A:
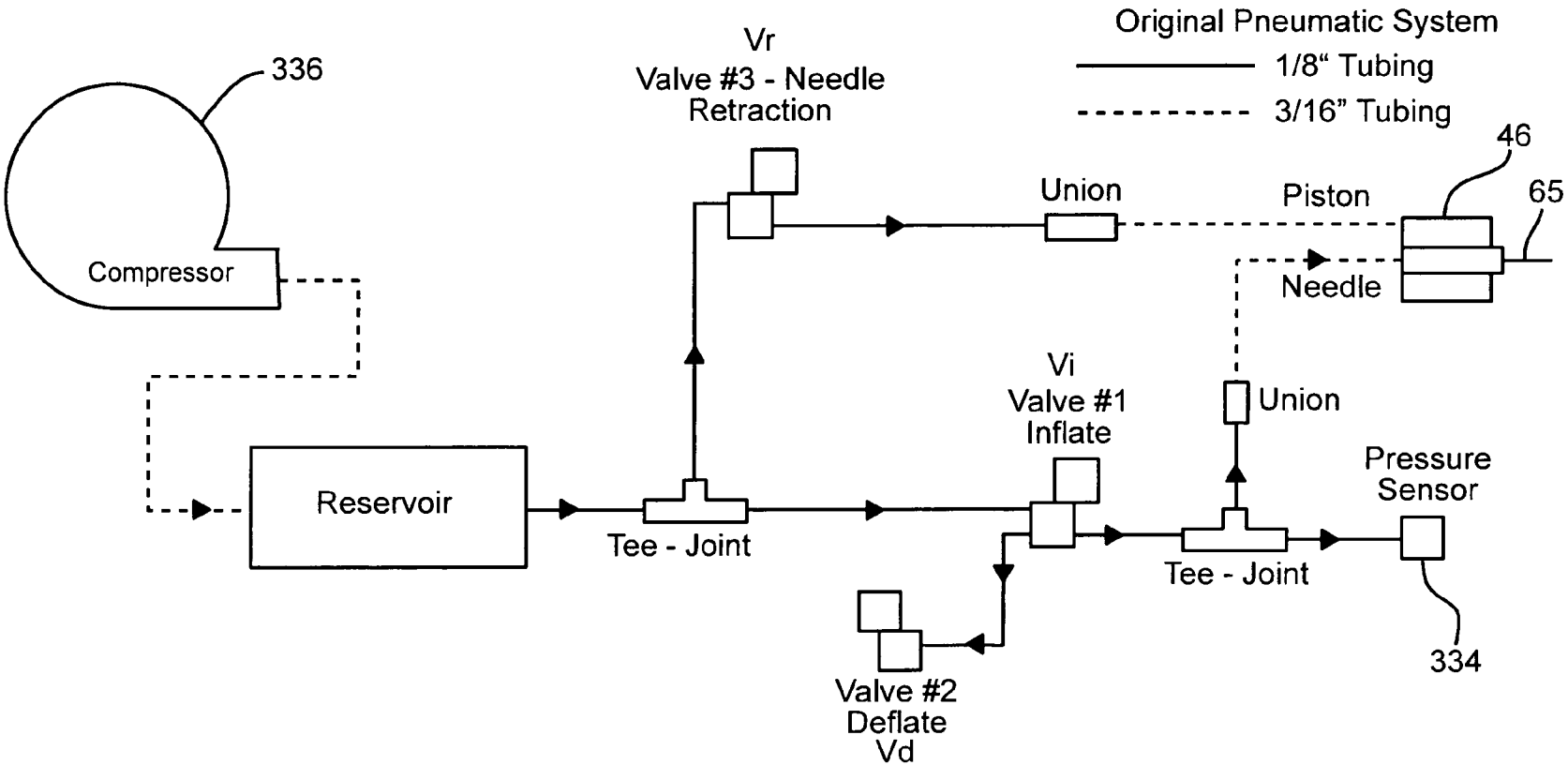
FIG. 19A is a schematic of one embodiment of a pneumatic system for the device 310.
Figure 19B:
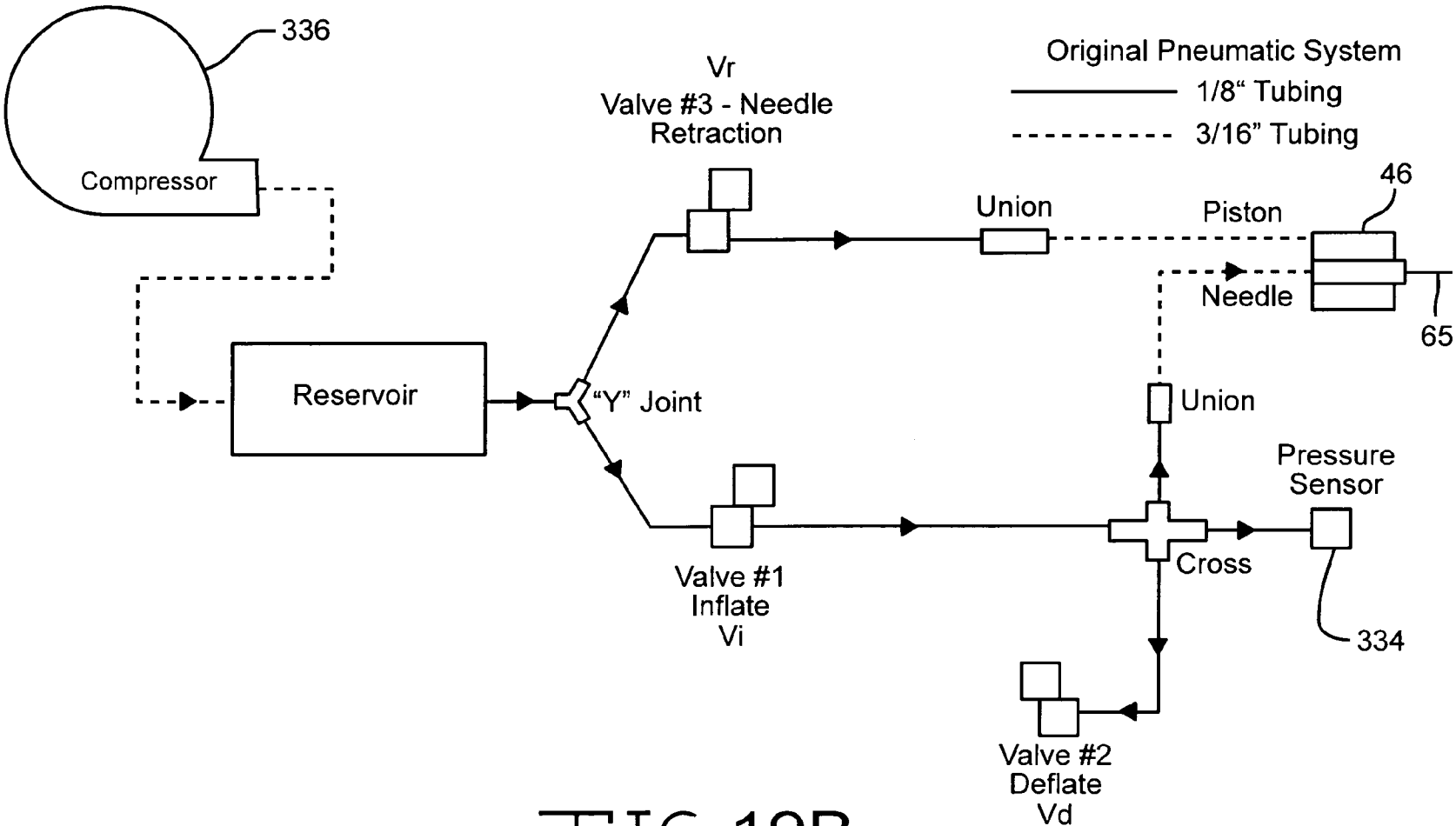
FIG. 19B is an optimized embodiment of a pneumatic system for the device 310, showing the needle retraction valve Vr, inflation valve Vi, the deflation valve Vd, and the pressure sensor in relation to the injection apparatus 46.

The mechanical systems were also modified in the third embodiment of the device 310. The inflation apparatus 46 was machine fabricated and is therefore robust. A set of specifications were calculated and determined from the first generation prototype device 10 to select a compressor 336 for the device 310. The compressor 336 was selected to have an equal or increased performance as well as reducing weight and size. Lastly the, pneumatic system inside the case, as shown in FIGS. 19A and 19B was modified for a more efficient and compact layout. The overall packaging of the device 310, as illustrated in FIG. 12 houses all of the unit's electronics and mechanical components. A small storage compartment 313 is included to store the injection apparatus 46 and power cord 315. The user control panel 312 interface was also placed on the outside of the device 310 to allow for easy operation. The modifications of device 310 resulted in a 40% reduction from the original unit in both size and weight. The device 310 is also more user friendly, with more options for the user to choose from. The entire device 310 is also more robust and portable then the first generation inflation device 10.

The device 310 pressurizes a ball 100 to a specific user defined air pressure and then extracts the needle 46 automatically once the ball 100 reaches the desired pressure. The device 310 was designed with the intent that it would be used by sports teams and camps so that they would have the ability to precisely adjust the pressure of the balls used in competition. Athletic performance can be drastically changed by how the ball bounces. The bounce is reliant on the internal product of ball pressure. Research has shown that from a ten foot drop the difference from a ball at 7 PSI and at 9 PSI is six inches of bounce height. Furthermore, air is lost when withdrawing the needle which can significantly alter the pressure inside the ball. The device 310 eliminates this problem by incorporating an automatically retracting needle 65, pulling the needle 65 out at a right angle and eliminating human error. The device 310 includes a control circuit board inside an aluminum case 311A, with an air compressor 336, a reservoir 340, an LCD display 318, and four preset air pressure buttons 316.

The device 310 has the following characteristics. Functionality: The device 310 inflates or deflates a ball, extracts the needle 65, and guides the user select to a pressure. The device 310 is accurate within 0.1 PSI and be able to inflate or deflate a ball to a specified PSI within the time of the original unit. Durability: The device 310 was created with sports teams in mind. The device 310 is very reliable and durable, so quick and accurate game time ball pressure can be made. Weight: The design is lightweight and easy to handle. Size: The device 310 is a compact unit that makes it easier to transport and use. The size can be optimized by using smaller components and modification of the system layout. Ease of Use: The user interface and manual procedure required in order to inflate or deflate a ball is easy to use. Maintainability: The device 310 must be able to be easily and quickly adjusted by the user. The packaging is accessible to perform maintenance in case of failure or when parts need to be replaced.

Figure 13:
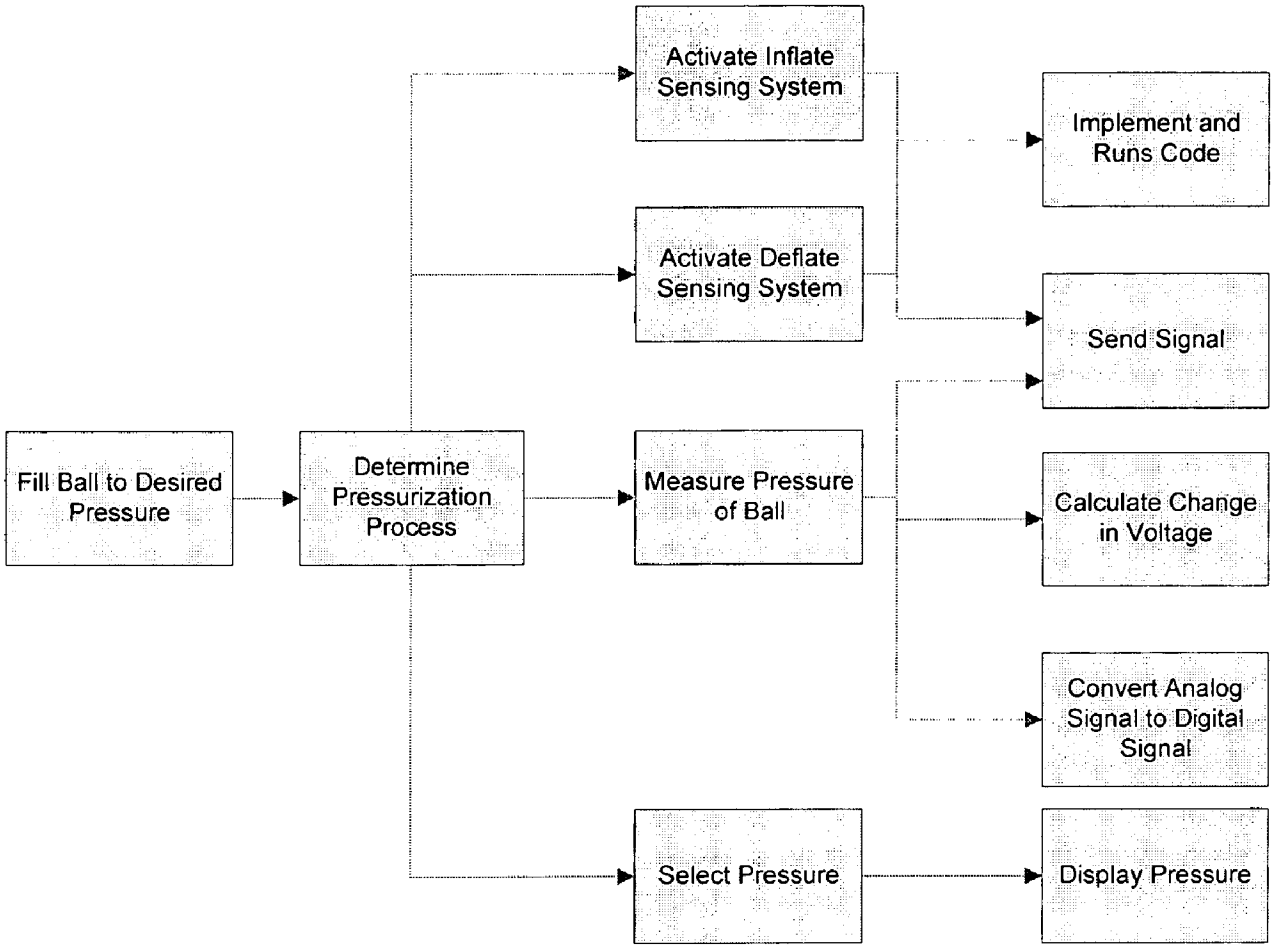
FIG. 13 illustrates the FAST Diagram of the functions of the third embodiment of the inflation device 310.
Figure 14:
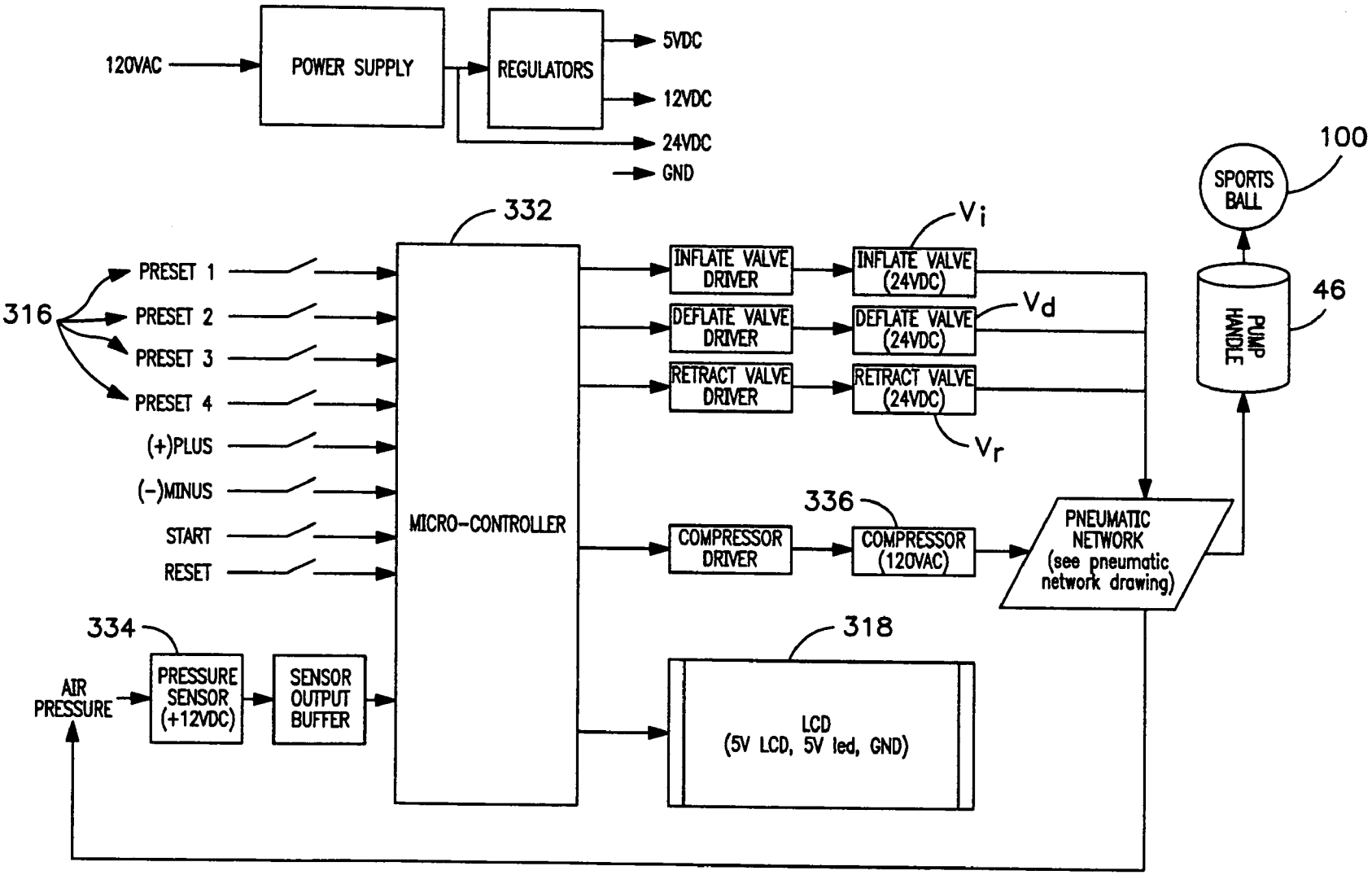
FIG. 14 is a block diagram showing the electrical system of the device 310.
Figure 15:
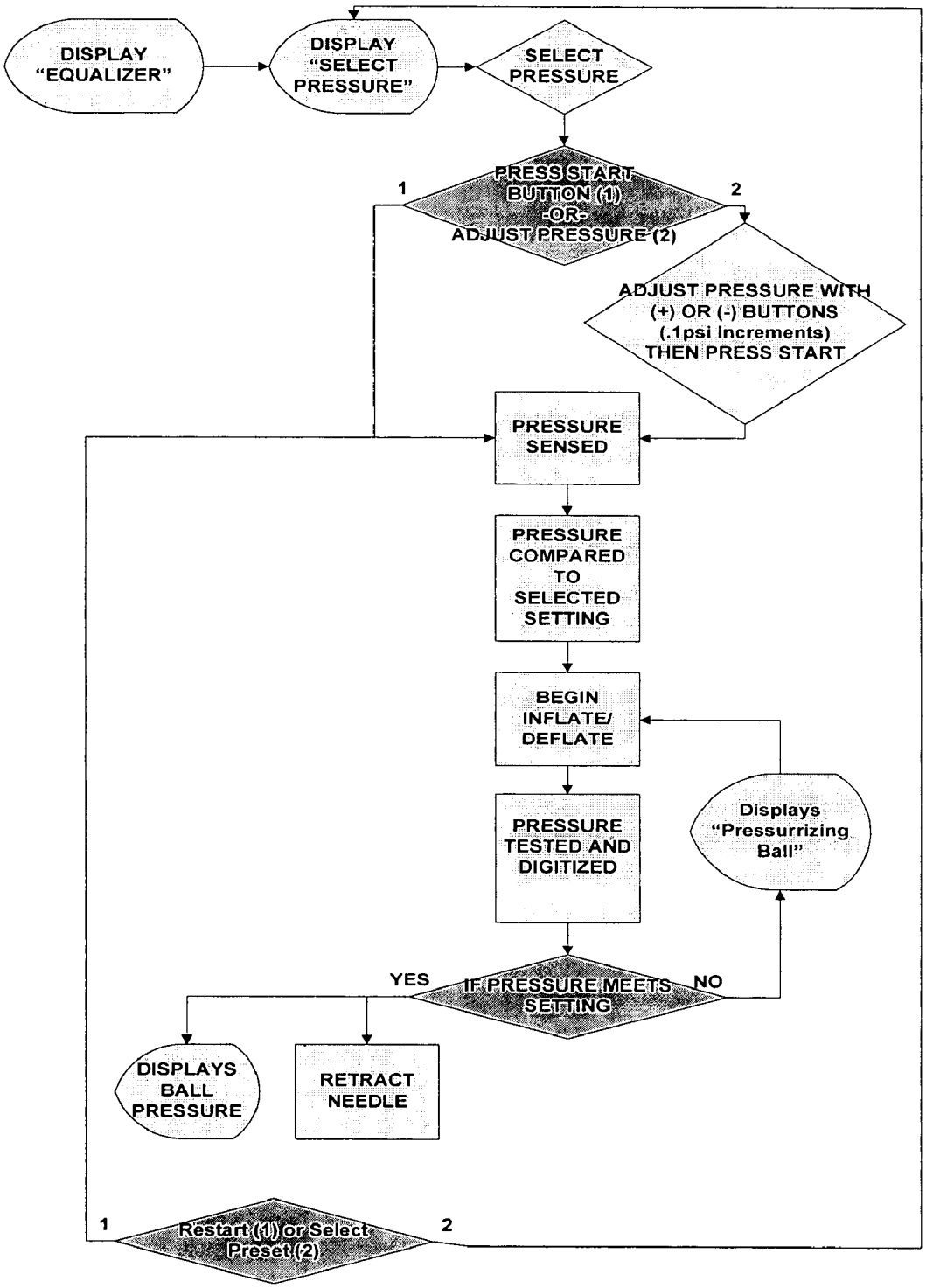
FIG. 15 is a functional flow chart of the software for the microcontroller 332 of the device 310.
Figure 16A:
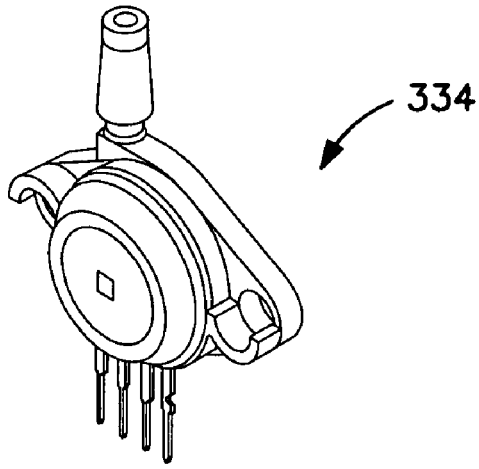
FIG. 16A is an illustration of one embodiment of a pressure sensor for the device 310.
Figure 16B:
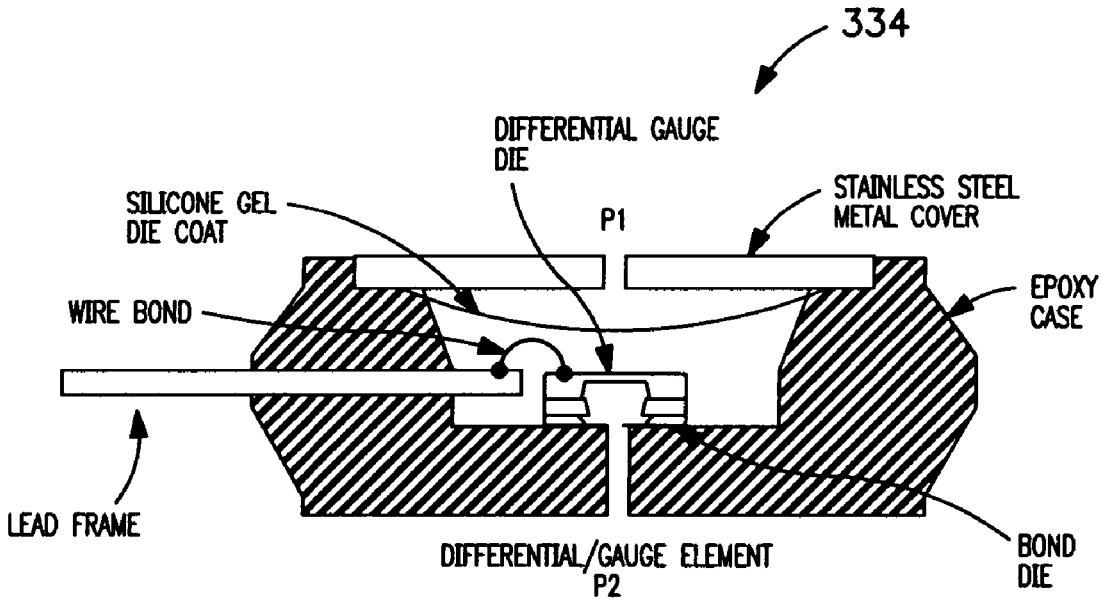
FIG. 16B is a cross-sectional schematic illustration of the pressure sensor of FIG. 16A.

1. Electrical Design: A FAST diagram, as shown in FIG. 13, illustrates the functional process of the device 310. FIG. 14 is a block diagram showing the electrical system, described below, to enable such a process.

1.1 User Interface System: The user will have the option of selecting from four pre-set standard pressure values for various sports balls. The user can then start pressurizing the ball, using the "START" button 319, illustrated in FIG. 12, to begin the process, or adjust the pressure up or down in increments of 0.1 PSI with the "+", or "−" buttons. The inflation device 310 allows for 5.1 PSI to 14.5 PSI pressures. Typically a basketball is filled to 8 PSI and a football is filled to 13 PSI. This rating is typically printed on the ball and regulated by sports governing bodies. When the ball 100 is inflated the needle 65 will retract automatically and the device 310 will reset. If the user chooses to fill another ball to that same pressure they can simply press the "START" button 319 again without going through the pressure setting algorithm. At any point during this process a "RESET" button 321, illustrated in FIG. 12, can be pushed to stop the unit. The process of choosing a pressure and pressurizing a ball 100 will be handled entirely by software for the microcontroller 332, as illustrated in the functional flow chart of FIG. 15. Doing this will require source coding compatible with the microcontroller 332 and sufficient input/output ports to drive each component.

Figures 1, 20:
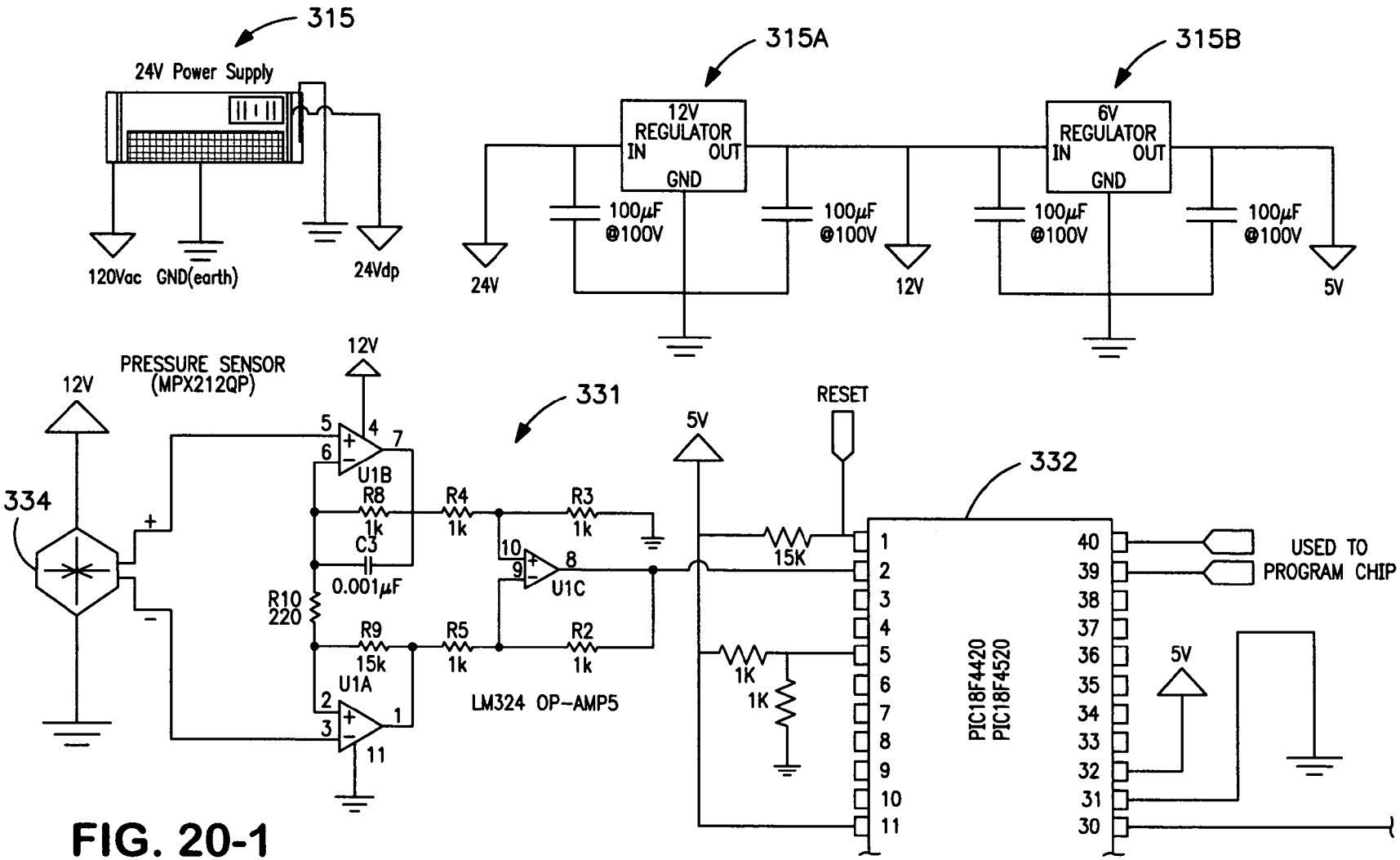
FIG. 20 is an electrical schematic of one embodiment of the control circuit for the device 310 using a PIC18F2520 microcontroller 332.
Figures 2, 20:
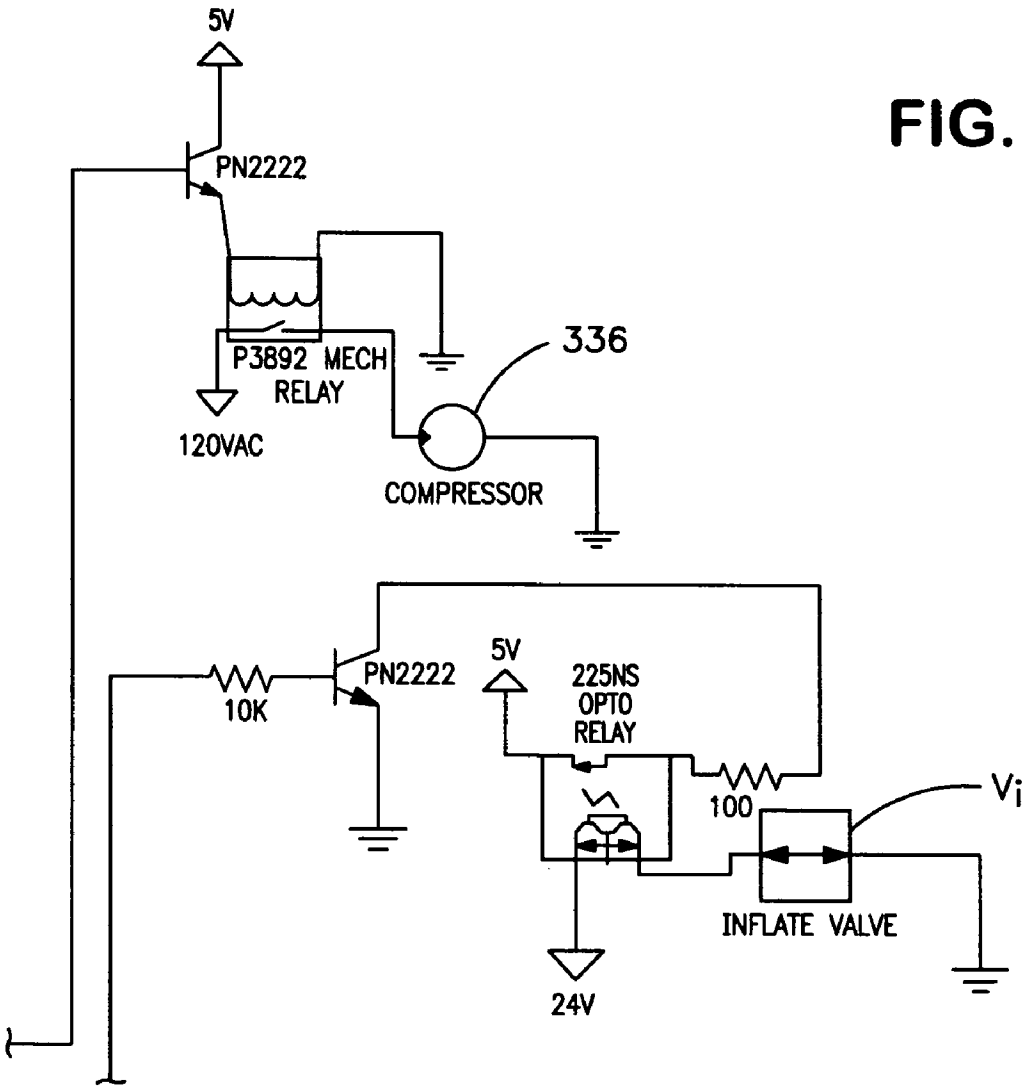
Figures 3, 20:
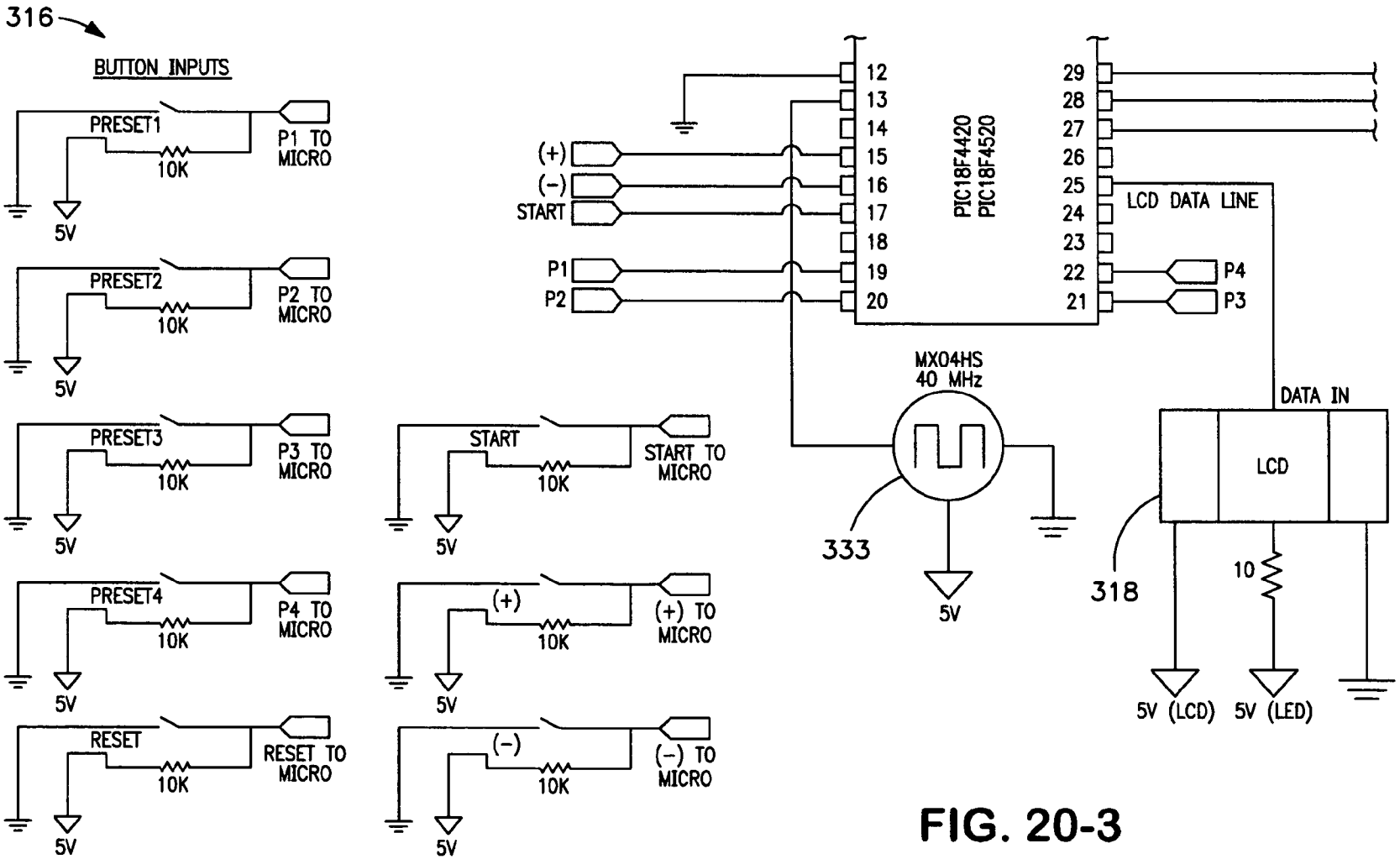
Figures 4, 20:
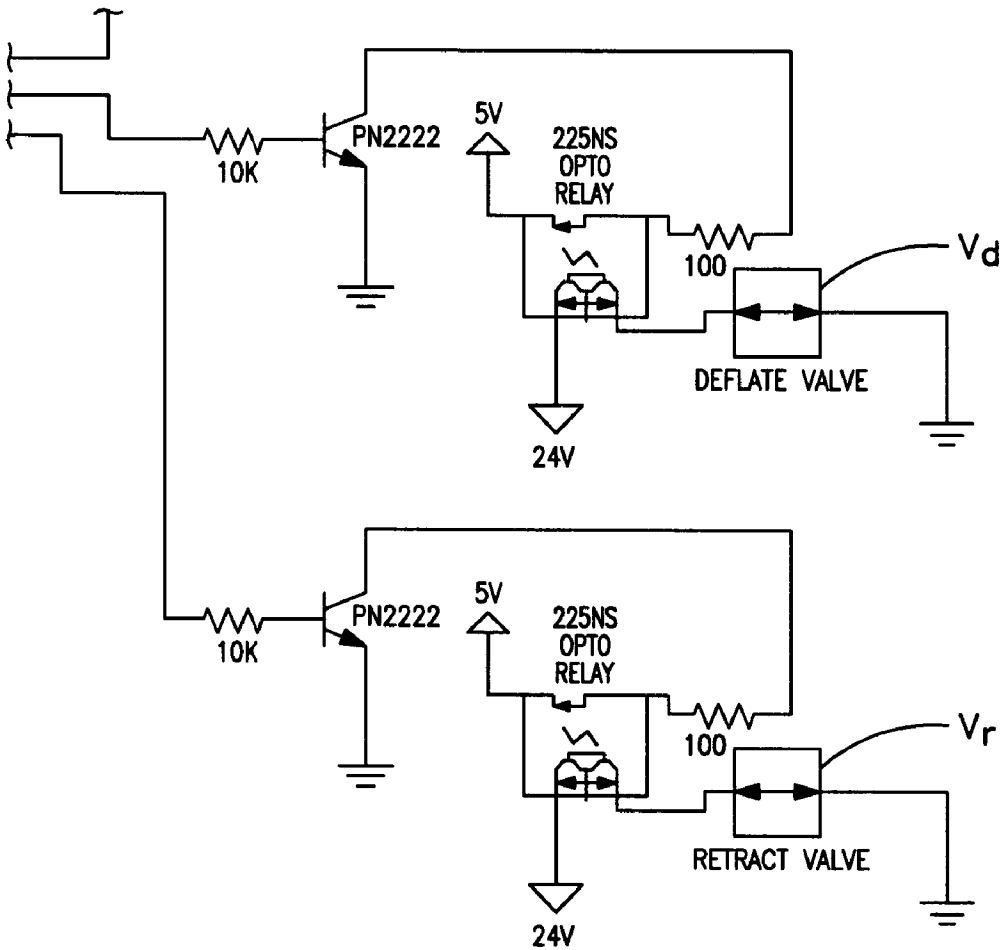

1.2 Microcontroller Hardware: The microcontroller 332 used in one embodiment of the device 310 is the Microchip (Microchip Technology, Inc., Chandler, Ariz.) PIC18F4520 40-pin PDIP. As seen in FIG. 20, this chip has a total of 36 pins as I/O ports. Four pins are used for a ground and voltage supply. The PIC18F4520 40-pin PDIP chip operates from a voltage of 2.0 V to 5.0 V and has a high-current 25 mA sink/source. This voltage range fits our design well as the optical relays and other components can be powered from the same voltage source. There is a 10-bit, 13-channel analog to digital converter on the chip. This 10-bit A/D conversion is important because the unit needs a very accurate reading of the pressure being sensed so the ball can be precisely pressurized to 0.1 PSI. An external clock 333 is required, and a 40 MHz MX045HS was selected. This oscillator will meet the specifications for pressure sampling and overall chip speed. This chip is self programmable under software control and uses a C complier optimized architecture.

1.3 Micro-Controller Software: The coding was done entirely in C and programmed using a MICROCHIP MPLAB ICD 2. All declarations are made at the beginning of the code. These include the voltage value equivalents of all preset pressures, the voltage value equivalent of 0.1 PSI, A/D conversion of the pressure sensor buffered signal, and any variables used in coding. The code is separated into five distinct sections, one for each of the four separate presets, and one "START" button 319 only case. Within each of the preset routines is an adjustment routine that allows the user to adjust the PSI if desired. The "START":button 319 only case is run when the user presses the "START" button 319 to begin pressurizing the ball after selecting a preset value. When the user wants to pressurize the ball to the last chosen preset, the "START" button 319 can be repressed to repeat the same pressure.

The A/D conversion of the pressure sensor 334 buffered signal occurs within the microcontroller 332 chip after a routine is selected. The microcontroller 332 samples at the rate of the external clock, and the results are put into a data stream that is then used in the software to determine what routine the device 310 should execute (inflate, deflate, retract).

Inflate: When user selected pressure is greater than the actual pressure read inside the ball 100 the software will drive the inflate routine. Here, the microcontroller 332 sends signals to open the inflate valve Vi and closes the retract valve Vr and deflate valve Vd. The microcontroller 332 also sends a signal which turns on the compressor 336. This creates a closed system that will force air directly into the ball 100. The pressure increase, and in turn the equivalent voltage signal fed to the microcontroller 332, is extremely linear, which makes the transition into the retract routine very smooth and predictable.

Deflate: When user selected pressure is less than the actual pressure read inside the ball, the software will drive the deflate routine. In this case the microcontroller 332 sends signals to open the deflate valve Vd and close the retract valve Vr and inflate valve Vi. The compressor 332 is turned off because it is not needed at this point. When the deflate valve Vd is open the pneumatic system, illustrated in FIG. 19A or 19B is no longer a closed system but rather open to the environment, so that the ball 100 can lose pressure.

Since the pressure sensor 334 is located between the ball 100 and the atmosphere, the pressure readings of the sensor 334 are very erratic and unreliable during deflation. To overcome this problem, a section of code was added to deflate for a set amount of time regardless of the pressure readings while the deflate valve Vd is open. If need be this routine will be run multiple times until the ball pressure is just below the desired pressure which will then trigger the inflate routine described above.

Retract: When user selected pressure, or the pressure read by the sensor 334 is equal to the actual pressure inside the ball 100 the software will drive the retract routine. In the software, a band of acceptable pressure is defined as ±0.05 PSI within the desired pressure. Since the system is always in an inflate routine, and never in deflate routine before retraction, once the pressure read is within the band the microcontroller will send signals to open the retract valve and close the inflate and deflate valves. The compressor is then turned on and air is redirected into the retract compartment of the inflation apparatus 46 needle mechanism, which then forces the needle 65 out of the ball 100.

1.4 Pressure Sensor Buffer Circuitry: In one embodiment of the device 310, the pressure sensor 334 chosen is the Freescale Semiconductor (Austin, Tex.) MPX2102GP, as seen illustrated in FIG. 16A and 16B. The pressure sensor 334 is piezoresistive which gives a linear voltage output relative to the pressure applied. This linear output is ideal for this device 310 because the coding allows for calculation of what voltage value a specific pressure will give, and incorporate it into the appropriate algorithm.

The output of the pressure sensor 334 is measured between two pins, and extra circuitry is needed to subtract the two voltages. This differential voltage is used in the software. At equilibrium, the difference between the two output pins is 0.0004 volts. This number is far too small to be input into the A/D conversion, and needed to be boosted. The buffer circuit used accomplishes three things: subtracts the "−" output voltage from the "+" output voltage, then boosts that signal to give a sensor voltage range of 0 to five volts, and does all of this without distorting the intended pressure reading.

Figure 17:
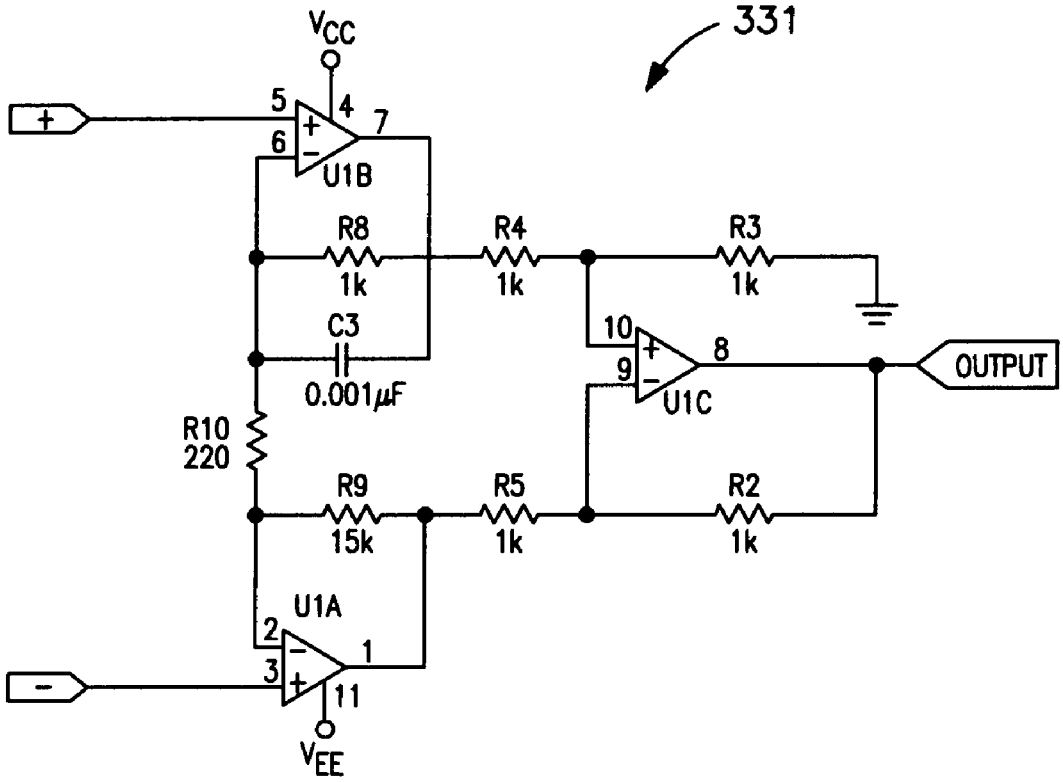
FIG. 17 is an illustration of the an instrumentation amplifier for the control circuit of the device 310. All op-amps are LM324, $V_{cc}$=12V DC, $V_{EE}$=GND.

The classical instrumentation amplifier 331, as illustrated in FIG. 17, can meet all of these needs. The amplifiers are selected for their small common mode gain, DC offset, consistency, and accuracy. This amplifier subtracts the two pressure signals and boosts the output from a range of 0 to 40 mV, to a range of 0.8 to 4.5 V. This allows the microcontroller 332 to make a very accurate A/D conversion and use that value in the programming.

1.5 Development Board: A development board for bench testing and micro-controller programming was designed and built on a bread board. This allowed for testing of the microcontroller 332 or other microprocessor and the associated software independent of the rest of the system. By using a simulated pressure sensor output voltage signal, generated by hand with a power supply or by function generator, as the input to the chip is possible to test all functionality, presets, and adjustment routines one could encounter when operating the system.

Figure 18:
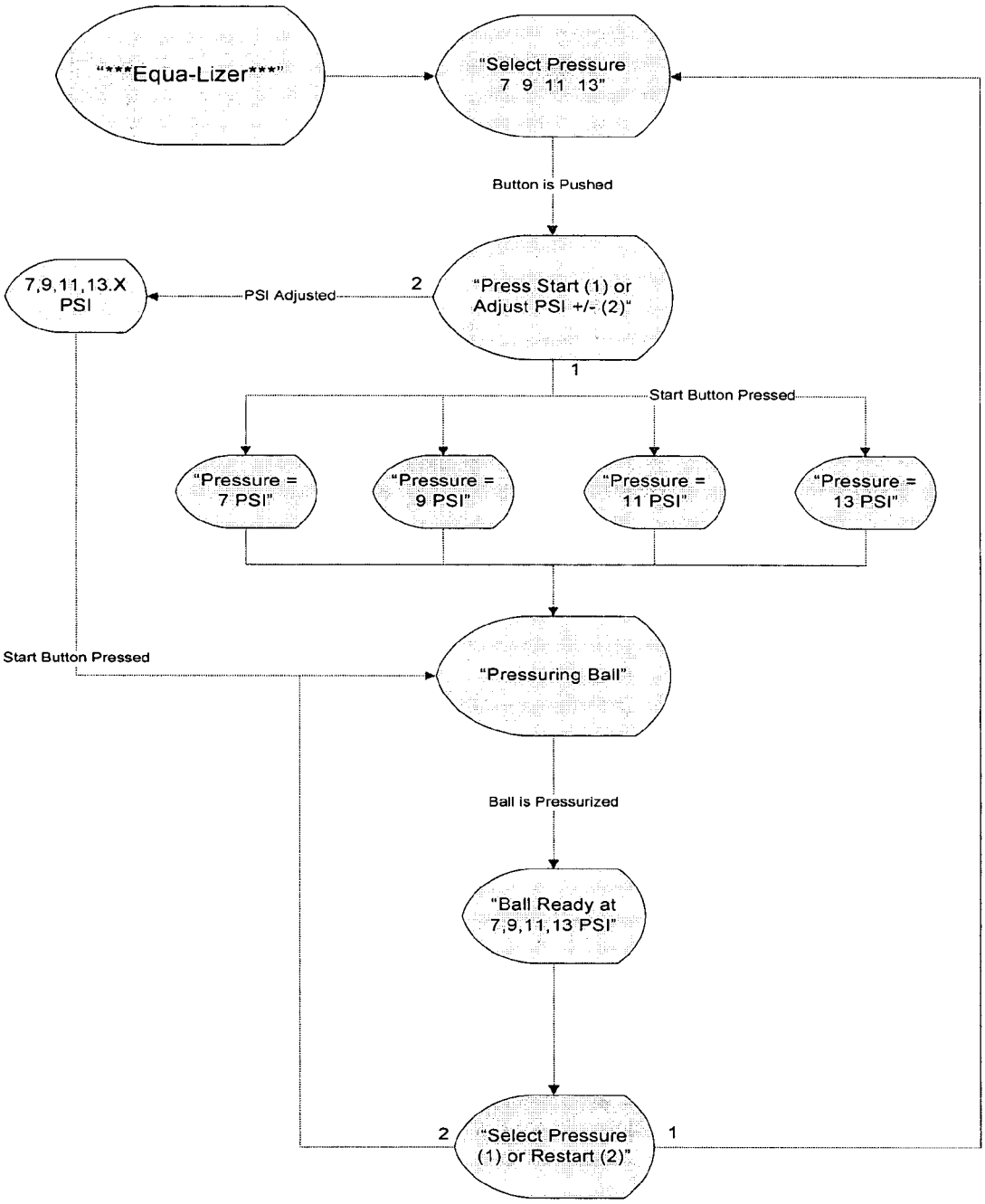
FIG. 18 is an LCD Display flowchart for the device 310.

1.6 Liquid Crystal Display: FIG. 18 is an LCD display flowchart for the device 310. The LCD display 318 used in one embodiment of the device 310 is a Crystalfontz (Crystalfontz America Inc., Spokane, Wash.) CFA632-YFD-KS LCD. This display is a large font 16×2 serial character LCD with a yellow black light. This LCD uses the transmit (TX) capabilities and is only connected by one pin from the microcontroller 332. This is an advantage over typical parallel connected LCD because more microcontroller pins are available for other applications. The 632 series LCD is easier to integrate into the project and coding with the use of a header file, cf632lib.h.

1.7 PCB Design: Once the electrical design had been decided, all of the parts needed to be integrated into a printed circuit board. Using the Cadence Layout software, a PCB was designed that could be made in Michigan State University College of Engineering's ECE Shop. The PCB was then populated and tested to verify functionality. The first PCB design had through-holes for most of the connections. A second PCB was designed and fabricated with any necessary modifications from the first identified through testing. Additionally, connectors, headers, and wires were integrated for completeness and to reduce manufacturing complications. This also made for more efficient trouble-shooting, testing, and reprogramming of the microcontroller 332.

1.8 Power Supply and Regulators: In order for the system to run optimally while maintaining efficiency it is important to find a power supply 315 that will not only meet the demands of the system but also be cost efficient. The demands of our device 310 as calculated and estimated are as follows:

1. The current draw maximum is 1A (electronics).

2. The voltages needed are:

(a) +5V dc for the Logic/Processor/Relays;

(b) +12V dc for the pressure Sensor;

(c) +24V dc for the valves; and (d) 120V ac for the compressor (0.8A).

These demands make the Mean Well (Fremont, Calif.) PS-65-24 open cage power supply a natural candidate for our power supply.

TABLE 1

| Power Supply Specifications. | | |
|---|---|---|
| Output Specifications: | | |
| Output Voltage: | 24 | Volts DC |
| Min Current: | 0 | Amps |
| Max Current: | 2.7 | Amps |
| Power: | 64.8 | Watts |
| Input Specifications: | | |
| Input Voltage: | 90~264 | VAC Universal Input |

The advantages of this power supply 315 include that it is open caged, and that it is able to cool by convection. This is important because the power supply will be enclosed inside the finished device 310, and needs to be cooled as easily as possible. Also, the dimensions, 107×61×28 mm, meets our size requirements. Most importantly, the output voltage of 24V DC will allow for direct power, through a driver/relay circuit, to the valves Vi, Vr, Vd. As seen in FIG. 20, this voltage is then stepped down by a LM7812 regulator 315A to yield +12V for the pressure sensor and instrumentation amplifier. The +12V is then stepped down again to +5V by a LM7805 regulator 315B to supply power to the microprocessor 332 and the rest of the circuitry. The compressor 336 and power supply 315 are powered by 120V AC directly from the wall, and the unit is equipped with a fuse 317, as seen mounted in the front control panel 312 in FIG. 12, to protect the entire system. The circuitry on the PCB is protected from voltage spikes by placing a capacitor before and after each regulator as well as by the power supply which contains over voltage, low voltage, and short circuit protection.

2. Mechanical Design 2.1 Inflation Characteristics, Testing Data: The individual components of the pneumatic system were optimized, without decreasing the inflation time. The third embodiment of the device 310 inflated the ball in at least the same amount of time as the original prototype of the device 10. The original compressor of the device 10 was over specified and required a choke valve to reduce the flow. The original system was limited to the amount of air that could flow out of the needle 65. This flow is an exact compressor requirement not including losses. The original device 10 was then tested using the standard preset pressures of 5, 7, 8, and 9 PSI. For the testing the ball was first set at 5 PSI then filled to 7 PSI. Then reset at 5 PSI and inflated to 8 PSI. The third pressure interval was finally for 5-9 PSI. During testing two different types of balls were used to determine if ball material had an impact on inflation time.

TABLE 2

Inflation times for First Generation Prototype

| | | Desired Pressure (PSI) | | | | | Desired Pressure (PSI) | | |
|---|---|---|---|---|---|---|---|---|---|
| Wilson | | 7 | 8 | 9 | Spalding | | 7 | 8 | 9 |
| Initial | 5 | 11 | 16 | 22 | Initial | 5 | 12 | 20 | 24 |
| Pressure | 5 | 11 | 19 | 23 | Pressure | 5 | 14 | 21 | 25 |
| (PSI) | 5 | 13 | 19 | 23 | (PSI) | 5 | 14 | 19 | 26 |
| | 5 | 10 | 16 | 22 | | 5 | 13 | 20 | 25 |
| | 5 | 11 | 19 | 25 | | 5 | 13 | 21 | 27 |
| Mean Time | | 11.2 | 17.8 | 23 | Mean Time | | 13.2 | 20.2 | 25.4 |

Using the data collected and the Ideal Gas Law as seen in Equation 1 from thermodynamics the mass of the air in the ball before and after inflation was calculated.

$$pV = \frac{m}{M}RT \qquad \text{Equation 1}$$

This difference in mass was then divided by the inflation time to produce a mass flow rate. Once the mass flow rate was found the final conversion was to the volumetric flow rate at a specific back pressure. The volumetric flow rate is the main specification for compressor. This volumetric flow rate from the original compressor would allow the second generation compressor to be selected.

The final segment of inflation characteristics is validating inflation time for the second prototype of the device 310. This was completed by subjected the second prototype of the device 310 to the same testing regiment as the first. Table 3 shows that the second unit exceeded expectations by having a faster inflation time by about 1 second.

TABLE 3

Inflation times for Second Generation Prototype

| | | Desired Pressure (PSI) | | | | | Desired Pressure (PSI) | | |
|---|---|---|---|---|---|---|---|---|---|
| Wilson | | 7 | 8 | 9 | Spalding | | 7 | 8 | 9 |
| Initial | 5 | 10 | 16 | 21 | Initial | 5 | 12 | 20 | 24 |
| Pressure | 5 | 10 | 18 | 21 | Pressure | 5 | 12 | 19 | 25 |
| (PSI) | 5 | 9 | 18 | 22 | (PSI) | 5 | 11 | 19 | 23 |
| | 5 | 10 | 16 | 21 | | 5 | 12 | 20 | 25 |
| | 5 | 11 | 16 | 22 | | 5 | 13 | 18 | 24 |
| Mean Time | | 10 | 16.8 | 21.4 | Mean Time | | 12 | 19.2 | 24.2 |

2.2 Compressor: There were several factors that went into selecting the compressor. These were weight, decibel rating, performance, and cost. The original compressor was 12 lbs and the weight requirement was to eliminate 3 lbs. The decibel rating could not be increased. The project sponsor had the unit evaluated by the S.C.O.R.E. committee or Service Corps of Retired Executives and a major selling point of the unit how little sound was emitted. The second prototype would have a ceiling at 60 decibels. The performance for the second compressor as described earlier in the inflation characteristics section. The compressor has to produce at minimum 0.5 CFM at 20 PSI. The final factor in selecting the compressor was the cost. The original compressor was again used as the standard, because the prototypes cost is a major factor for the product marketing. The second generation prototype compressor could be at maximum $150.

In one embodiment, the F1 FUSION was chosen as the compressor 336 for the inflation device 310. This compressor also had a built in safety feature that which made the F1 FUSION even more desirable for the device 310. This compressor 336 will automatically turn off if the outlet pressure ever reaches 50 PSI. In a scenario where the valves failed to open the compressor would previously operate until failure. This feature will prevent damage to the compressor 336 or valves Vi, Vr, Vd in case the unit is not operating correctly.

2.3 Valves: In one embodiment of the device 310, the SY113A-5L-PM3 Control Valves (available from Coast Pneumatics Anaheim, Calif.) were used for the valves Vi, Vr, Vd in the device 310. When choosing the valves Vi, Vr, Vd for this project a few parameters were first specified. During the valve selection process the compressor was also being chosen and this also influenced what type of valves would be selected. One of the determining factors was the power supply 315. The power supply 315 that was chosen would be able to supply the system with 24 volts and 2.7 amps. Therefore a valve Vi, Vr, Vd that would operate on 24 volts and 31 mA of current was chosen. In addition a type of valve Vi, Vr, Vd was chosen that had a larger flow rating than the others. This was done in order to decrease the losses that would be associated with the valves Vi, Vr, Vd as well as to provide the greatest amount of flow to the needle to fill the ball in the shortest amount of time. The maximum pressure for the valve is 100 PSI, while the compressor maximum rating of 50 PSI. This design consideration allows for a safety factor of 2. In addition to the selection of the valves Vi, Vr, Vd the configuration in which they were placed was also changed, as seen in FIGS. 19A and 19B. The major reason behind this was to simplify the design as well as to eliminate a specialty part that would have had to been custom made. This new plumbing design was also more compact, which worked better for the packaging of the system within the case.

2.4 Inflation apparatus needle mechanism: The needle mechanism, as illustrated in FIGS. 4A, 4B, 5A and 5B, is an important component of the device 10, 210, 310, since it is what will be used to inflate the ball 100. After the ball 100 has been inflated, air is pumped into the chamber 64, causing the needle 65 to retract and remove itself from the ball 100. One of the major considerations in the design of the injection apparatus 46 was robustness. Since this part will go through continuous and many cycles during its lifetime, the inflation apparatus 46 mechanism needs to be designed to withstand repetitive use. In one embodiment, a metal insert was fabricated as the inner wall 52, that could be secured into the acrylic. This metal insert then holds a standard sports needle 65 that is used to inflate all types of balls. With this design a needle 65 can easily be changed. Quality rubber seals 57, 59 were also selected and used to provide an excellent seal for the retraction chamber 64. In one embodiment, vinyl inserts (not shown) were selected and used to connect the tubing of the gas transport hose 67 and the retraction hose 68 to the needle mechanism 65. These inserts provide support to the tubing to prevent it from bending and kinking.

2.5 Packaging: The inflation device 310 was packaged as a whole unit in the case 311A. The case 311A of the device 310 can have a compartment 313 that can store the needle mechanism 65 and the power cord 315. The first component placed was the compressor 336. Since this was the heaviest component, the position was fixed directly under the handle 311C. The power supply 315 was then placed below the compressor 336 and the printed circuit board for the control circuit 330 above. This was done to prevent thermal energy from the heat sinks damaging the printed circuit board. The air reservoir naturally fit vertically or else the package would have been extremely wide. The LCD display 318 and push buttons 316 were placed on the face of the device 310 which created a void which was used for the inflation apparatus 46 and power cord 315 compartment 313. The final components to be added were the valves Vi, Vd, Vr. These were place behind the LCD display 318 adjacent to the compartment 313.

The material was used for one embodiment of the device 310 was stock aluminum. This was selected because of the material being light weight and easy to weld. The package was then powder coated by Detronic Industries textured yellow. The overall volume was reduced from 1404 cubic inches to 840 cubic inches and the weight was reduced from 24 lbs to 14 lbs.

Final Design Performance: The electrical system controls all functions of the inflation device 310. The microcontroller 332 in collaboration with driver control circuitry 330 and all other components accurately drives the system. Additionally, the integration of the LCD 318 and user interface of the panel 312 allows the user to easily operate the system without confusion. The unit can only be as accurate as the pressure sensor 334, and associated buffer circuitry 331. This measurement is used within the microcontroller 332 to determine which routine is appropriate. Because this measurement is very linear its performance is consistent and accurate. Lastly, the PCB design (FIG. 21) helped to reduce the device 310 in size and increase durability. Its robustness and the ability to swap out various components make it easier to manufacture and repair, and more reliable for the user.

Figure 21:
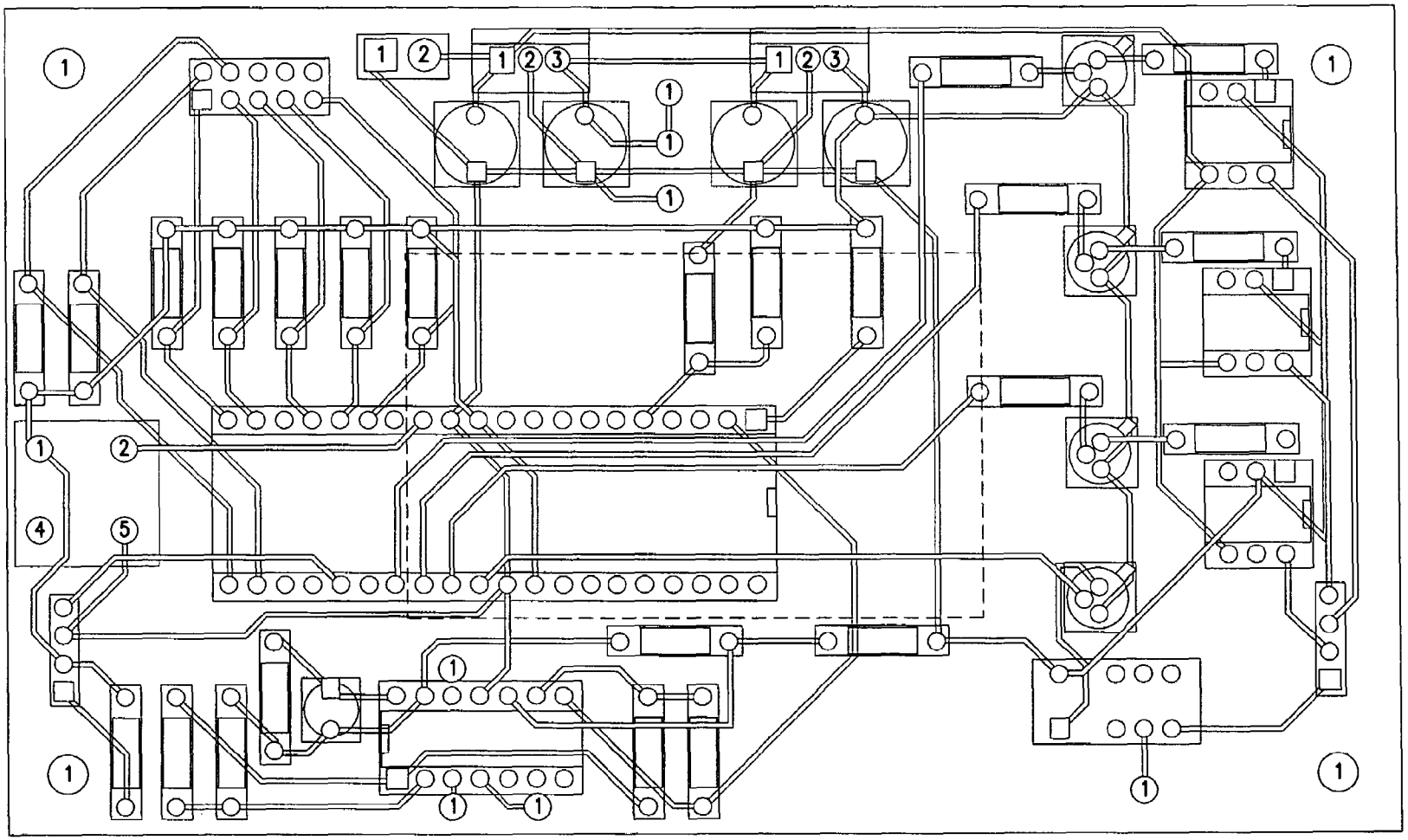
FIG. 21 shows the PCB design of the device 310.

Specifications were made during the design of the project; two of these were size and weight. The size of the second prototype was to be at least one third in volume of the original prototype. The weight was also specified to be at most fifteen pounds, which would be nine pounds lighter than the first prototype. The final prototype device 310 measured in at 12"×10"×7" yielding a final volume of 840 cubic inches, this also includes an 8"×10"×2" storage compartment 313 that houses the injection apparatus 46 and associated tubing along with the power cord 315. The first prototype had a total volume of 1404 cubic inches and did not have any other separate storage for the needle mechanism. This change in size yielded a 40% reduction in the volume of the case. Two major components allowed for the vast reduction in size, the compressor and the printed circuit board (FIG. 21). The compressor 336 that was selected was small and the performance of the system did have to be compromised. The weight of the final prototype was also a vast improvement over the first unit. In one embodiment, the final product with all components weighed in at 14 pounds, whereas the first unit was 24 pounds. We were able to reduce the overall weight of the system by 10 pounds, yielding a 41% reduction in weight. One of the major contributing factors to the reduction in weight was again the selection of the compressor 336. The compressor 336 that was selected was 50% lighter than the compressor 36 that was used in the first unit. This equated to an automatic reduction of 6 pounds.

Conclusion: The finished inflation device 310 has an optimized electrical system. All of the components are integrated onto one printed circuit board (FIG. 21), to which all of the peripherals are connected. The system is controlled by a PIC microcontroller 332 that runs a custom-written set of C code. The microcontroller 332 interfaces with a pressure sensor 334, eight buttons 316, three valves Vi, Vd, Vr, a compressor 336, and an LCD display 318. All of these functions work together to allow the user to select a specific pressure, and then inflate a ball 100 to that exact pressure.

The reliability of the injection apparatus 46 has been increased by implementing a brass insert as the inner wall 52. This insert prevents the acrylic from wearing due to removing the needle 65. In one embodiment, a vinyl splice (not shown) is used to connect the tubing to the injection apparatus. This minor change allows to tubing or the needle to be simply disconnected and replaced. The compressor is lighter and quieter without losing any performance and has built in safety protection. The valves allow maximum flow with easy control. The package also allows the internals to be easily accessed. Finally the overall volume was reduced by 40% and the weight by 40%.

While the present invention is described herein with reference to illustrated embodiments, it should be understood that the invention is not limited hereto. Those having ordinary skill in the art and access to the teachings herein will recognize additional modifications and embodiments within the scope thereof. Therefore, the present invention is limited only by the Claims attached herein.

We claim:

1. An injection apparatus for inflating or deflating an inflatable object comprising:

(a) a housing having a top wall and an outer wall defining a center bore;

(b) an inner wall within the outer wall of the housing and extending across the center bore of the housing;

(c) a post slidably mounted in the inner wall;

(d) an inflation needle mounted upon an end of the post;

(e) a gas transport hose extending through the post and connected to the inflation needle to provide a gas supply to the inflatable object;

(f) a piston extending from the post across the center bore of the housing between a top wall and the inner wall so as to define a sealed chamber between the piston and the inner wall of the injection apparatus, the piston being slidably disposed against the outer wall and top wall; and (g) a retraction hose attached to the post to provide gas to the chamber between the piston and the inner wall, wherein when the gas is supplied to the retraction hose, the pressure in the chamber forces the housing down against the inflatable object so as to remove the inflation needle from the inflatable object.

2. The injection apparatus of claim 1, wherein the inflatable object comprises a game ball.

3. The injection apparatus of claim 1, wherein the gas transport hose and the retraction hose are attached to a gas supply means.

4. The injection apparatus of claim 1, wherein the gas supply means is a compressor.

5. An inflation device for inflating or deflating an inflatable object to a preselected pressure, which comprises:

(a) an inflation needle for insertion into an inflatable object;

(b) an inflation system comprising a gas supply means and a gas transport hose connected to the gas supply means, the gas transport hose connected to the inflation needle to provide gas to the inflatable object;

(c) at least one pressure selector provided on a control panel of the inflation device;

(d) a pressure sensor connected to the inflation system;

(e) a control circuit that opens valves in the inflation device to inflate or deflate the inflatable object, electrically connected to the pressure sensor and receiving an electrical signal from the pressure selector; and (f) an injection apparatus for inflating or deflating the inflatable object comprising: a housing having a top wall and an outer wall defining a center bore; an inner wall within the outer wall of the housing and extending across the center bore of the housing; a post slidably mounted in the inner wall; an inflation needle mounted upon an end of the post; an end of the gas transport hose extending through the post and connected to the inflation needle to provide a gas supply to the inflatable object; a piston extending from the post across the center bore of the housing between a top wall and the inner wall to provide a sealed chamber between the piston and the inner wall of the injection apparatus, the piston being slidably disposed against the outer wall and top wall; and a retraction hose attached to the post to provide gas to the chamber between the piston and the inner wall, wherein when the gas is supplied to the retraction hose, the pressure in the chamber forces the housing down against the inflatable object so as to remove the inflation needle from the inflatable object.

6. The inflation device of claim 5, wherein the control circuit comprises a microprocessor that opens valves to inflate or deflate the inflatable object.

7. The inflation device of claim 5, wherein the inflatable object comprises a game ball.

8. The inflation device of claim 5, wherein the gas supply means is a compressor.

9. The inflation device of claim 5, wherein the at least one pressure selector is provided as buttons or a dial on the control panel.

10. A method for inflating or deflating an inflatable object to a preselected pressure comprising:

(a) providing an inflation device comprising an inflation needle for insertion into an inflatable object; an inflation system comprising a gas supply means and a gas transport hose connected to the gas supply means, the gas transport hose connected to the inflation needle to provide gas to the inflatable object; at least one pressure selector provided on a control panel of the inflation device; a pressure sensor connected to the inflation system; a control circuit that opens valves in the inflation device to inflate or deflate the inflatable object, electrically connected to the pressure sensor and receiving an electrical signal from the pressure selector; and an injection apparatus for inflating or deflating the inflatable object comprising: a housing having a top wall and an outer wall defining a center bore; an inner wall within the outer wall of the housing and extending across the center bore of the housing; a post slidably mounted in the inner wall; an inflation needle mounted upon an end of the post; an end of the gas transport hose extending through the post and connected to the inflation needle to provide a gas supply to the inflatable object; a piston extending from the post across the center bore of the housing between a top wall and the inner wall to provide a sealed chamber between the piston and the inner wall of the injection apparatus, the piston being slidably disposed against the outer wall and top wall; and a retraction hose attached to the post to provide gas to the chamber between the piston and the inner wall, wherein when the gas is supplied to the retraction hose, the pressure in the chamber forces the housing down against the inflatable object so as to remove the inflation needle from the inflatable object;

(b) inserting the inflation needle into the inflatable object;

(c) selecting a pressure by means of the at least one pressure selector on the inflation device;

(d) sensing an initial pressure of the inflatable object with the pressure sensor;

(e) adjusting a pressure of the inflatable object to essentially equal to the preselected pressure by supplying gas to or removing gas from the inflatable object; and (f) retracting the inflation needle from the inflatable object when the pressure of the inflatable object is essentially equal to the preselected pressure.

11. The method of claim 10, wherein the control circuit comprises a microprocessor that opens valves to inflate or deflate the inflatable object.

12. The method of claim 10, wherein the inflatable object comprises a game ball.

13. The method of claim 10, wherein the gas supply means is a compressor.

14. The method of claim 10, wherein the at least one pressure selector is provided as buttons or a dial on the control panel.

* * * * *